US006159922A

United States Patent [19]

Williams

[11] Patent Number: 6,159,922

[45] Date of Patent: Dec. 12, 2000

[54] BLEACHING COMPOSITION

[75] Inventor: Fiona Susan (Mac Beath) Williams, Newcastle upon Tyne, United Kingdom

[73] Assignee: The Procter & Gamble Company, Cincinnati, Ohio

[21] Appl. No.: 09/155,465

[22] PCT Filed: Mar. 25, 1997

[86] PCT No.: PCT/US97/04957

§ 371 Date: Mar. 24, 1999

§ 102(e) Date: Mar. 24, 1999

[87] PCT Pub. No.: WO97/36989

PCT Pub. Date: Oct. 9, 1997

[30] Foreign Application Priority Data

Mar. 29, 1996 [GB] United Kingdom ..... 9606653

[51] Int. Cl.[7] ..... C11D 7/26; C11D 7/32; C11D 7/38; C11D 7/54

[52] U.S. Cl. ..... 510/372; 510/223; 510/224; 510/229; 510/303; 510/304; 510/309; 510/318; 510/361; 510/375; 510/477; 510/488; 252/186.38; 252/186.43; 8/137; 134/25.2

[58] Field of Search ..... 510/223, 224, 510/229, 372, 375, 376, 303, 304, 309, 310, 311, 312, 361, 477, 488, 318; 252/186.38, 186.43; 134/25.2; 8/137

[56] References Cited

U.S. PATENT DOCUMENTS

| | | | |
|---|---|---|---|
| 5,114,611 | 5/1992 | Van Kralingen et al. | 252/186.33 |
| 5,411,673 | 5/1995 | Agar et al. | 510/312 |
| 5,437,810 | 8/1995 | Ewbank et al. | 510/328 |
| 5,488,095 | 1/1996 | Boeckh et al. | 510/479 |
| 5,750,483 | 5/1998 | Welch et al. | 510/230 |
| 5,783,524 | 7/1998 | Greindl et al. | 507/90 |
| 5,786,313 | 7/1998 | Schneider et al. | 510/219 |
| 5,904,161 | 5/1999 | Rai et al. | 134/25.2 |
| 5,905,065 | 5/1999 | Scialla et al. | 510/280 |
| 5,955,415 | 9/1999 | Gutierrez et al. | 510/312 |
| 5,965,505 | 10/1999 | Baillely et al. | 510/311 |

*Primary Examiner*—Gregory R. Delcotto
*Attorney, Agent, or Firm*—David M. Goodrich; Kim William Zerby; Steven W. Miller

[57] ABSTRACT

Bleach compositions comprising a percarbonate bleach and an amino tricarboxylic acid exhibit a reduced tendency to deposit calcium carbonate insolubles on substrates being bleached. Laundry compositions comprising percarbonate bleach and methyl glycine diacetic acid are provided.

9 Claims, No Drawings

BLEACHING COMPOSITION

TECHNICAL FIELD

The present invention relates to a bleaching composition adapted for use in a cleaning method, exhibiting improved soil and stain removal.

BACKGROUND TO THE INVENTION

Compositions designed for use in cleaning, particularly in automatic dishwashing and laundry methods are well known and a consistent effort has been made by detergent manufacturers to improve the cleaning and/or rinsing efficiency of said compositions as reflected by many patent publications.

The satisfactory removal of bleachable soils such as tea, coffee and red wine is a particular challenge to the formulator of a bleaching composition. Traditionally, the removal of such bleachable stains has been enabled by the use of bleach components such as oxygen bleaches, including hydrogen peroxide and organic peroxyacids. The organic peroxyacids are often obtained by the in situ perhydrolysis reaction between hydrogen peroxide and an organic peroxyacid bleach precursor.

Traditionally, the most commonly used source of hydrogen peroxide has been perborate salts, such as sodium perborate monohydrate and tetrahydrate. Percarbonate salts, such as sodium percarbonate are alternative hydrogen peroxide sources which have the advantage of, after release of the hydrogen peroxide, additionally providing carbonate ions to the wash solution. Carbonate ions contribute alkalinity and builder capacity to the solution.

A problem associated with the use of percarbonate bleach is the formation of insoluble carbonate deposits. It is believed that carbonate ions released by the percarbonate bleach during perhydrolysis, complex with cations in the wash solution forming insoluble carbonate deposits. Additionally, once having formed, an initial minor carbonate deposit can act as a "seeding centre" for the formation of a larger, possibly composite, deposit structures, including those associated with redeposition of soils, lime soaps and silicate salts.

Lime soap deposits are most commonly encountered when the washload contains fatty soils, which naturally contain levels of free fatty acids, and when lipolytic enzymes are components of the formulation. Lipolytic enzymes catalyse the degradation of fatty soils into free fatty acids and glycerol. Silicate is a common component of machine dishwashing formulations, where it is added for its china care capability.

Deposit formation can occur on a range of commonly encountered substrate surfaces including fabric, plastic, glass, metal and china surfaces. Certain deposit types however, show a greater propensity to deposit on certain substrates.

The formation of insoluble carbonate, especially calcium carbonate, deposits are a particular problem in the machine dishwashing art. Such deposits are also problematic in laundry washing methods, where the deposits accumulate on the fabric surface (a phenomenon sometimes known as 'ash deposition') thereby causing the fabrics to take on a yellowed or dingy appearance.

The naturally sourced, inlet water to the dishwasher machine can be a sufficient source of $Ca^{2+}$ and $Mg^{2+}$ ions and $CO_3^{2-}/HCO_3^-$ ions to make deposit formation a problem. Whilst the salt softening system, through which the inlet water will pass prior to entry into the main cavity of a dishwasher machine, can be efficient at removing the naturally present $Ca^{2+}$ and $Mg^{2+}$ ions it is inefficient at removing the $CO_3^{2-}/HCO_3^-$ ions which therefore enter into the wash/rinse solution.

The Applicants have now established that both the levels of $Ca^{2+}/Mg^{2+}$ hardness ions and the levels of $CO_3^{2-}/HCO_3^-$ ions in the wash/rinse water of a dishwasher machine are factors controlling calcium carbonate deposit formation. Critical levels of all components must be exceeded for deposit formation to occur. These critical levels are to an extent interdependent. Thus, even in wash/rinse solutions containing high levels of one component, deposit formation will not occur in the absence of the critical level of the other component.

The Applicants have found that the problem of calcium carbonate deposit formation associated with the use of a percarbonate bleach, may be effectively ameliorated by the inclusion of amino tricarboxylic acid (ATCA) into a bleaching formulation.

SUMMARY OF THE INVENTION

According to the present invention there is provided a bleaching composition comprising (a) a percarbonate bleach compound; and (b) an amino tricarboxylic acid or salt thereof wherein said amino tricarboxylic acid has the general formula:

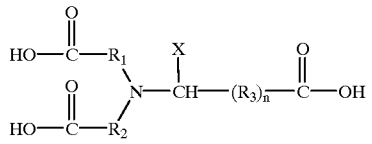

where $R_1$, $R_2$ and $R_3$ are alkyl groups or substituted alkyl groups of chain length C1 to C4; n is 0 or 1; and X is an organic substituent group.

DETAILED DESCRIPTION OF THE INVENTION

The present invention relates to a bleaching composition adapted for use in a cleaning method, exhibiting improved soil and stain removal.

Percarbonate Bleach

This invention has as an essential component a percarbonate bleach compound. Alkali metal or alkaline earth metal percarbonates, particularly sodium percarbonate are preferred percarbonates for inclusion in compositions in accordance with the invention. Sodium percarbonate is an addition compound having a formula corresponding to $2Na_2CO_3.3H_2O_2$, and is available commercially as a crystalline solid. Commercial suppliers include Solvay, FMC, Tokai Denka and others.

The percarbonate compound can be present at levels of between 1% and 50%, preferably between 2% and 30%, most preferably between 3% and 20% by weight of detergent composition.

The percarbonate is most preferably incorporated into such compositions in a coated form which provides in-product stability.

A suitable coating material providing in product stability comprises mixed salt of a water soluble alkali metal sulphate and carbonate. Such coatings together with coating processes have previously been described in GB-1,466,799, granted to Interox on Mar. 9, 1977. The weight ratio of the mixed salt coating material to percarbonate lies in the range from 1:200 to 1:4, more preferably from 1:99 to 1:9, and most preferably from 1:49 to 1:19. Preferably, the mixed salt is of sodium sulphate and sodium carbonate which has the general formula $Na_2SO_4.n.Na_2CO_3$ wherein n is from 0.1 to 3, preferably n is from 0.3 to 1.0 and most preferably n is from 0.2 to 0.5.

Other coatings which contain silicate (alone or with borate salts or boric acids or other inorganics), waxes, oils, fatty soaps can also be used advantageously within the present invention.

Oxygen-releasing Bleaching System

In one preferred aspect the bleaching composition contains the percarbonate bleach compound as a hydrogen peroxide source and an organic peroxyacid bleach precursor compound. The production of the organic peroxyacid occurs by an in situ reaction of the precursor with a source of hydrogen peroxide. Alternative sources of hydrogen peroxide include inorganic perhydrate bleaches. In a preferred aspect a preformed organic peroxyacid is incorporated directly into the composition. Compositions containing mixtures of a hydrogen peroxide source and organic peroxyacid precursor in combination with a preformed organic peroxyacid are also envisaged.

Peroxyacid Bleach Precursor

A highly preferred component of the bleaching composition is a peroxyacid bleach precursor. Peroxyacid bleach precursors are compounds which react with hydrogen peroxide in a perhydrolysis reaction to produce a peroxyacid. Generally peroxyacid bleach precursors may be represented as

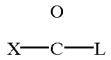

where L is a leaving group and X is essentially any functionality, such that on perhydrolysis the structure of the peroxyacid produced is

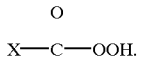

Peroxyacid bleach precursor compounds are preferably incorporated at a level of from 0.5% to 20% by weight, more preferably from 1% to 10% by weight, most preferably from 1.5% to 5% by weight of the compositions.

Suitable peroxyacid bleach precursor compounds typically contain one or more N- or O-acyl groups, which precursors can be selected from a wide range of classes. Suitable classes include anhydrides, esters, imides, lactams and acylated derivatives of imidazoles and oximes. Examples of useful materials within these classes are disclosed in GB-A-1586789. Suitable esters are disclosed in GB-A-836988, 864798, 1147871, 2143231 and EP-A-0170386.

Leaving Groups

The leaving group, hereinafter L group, must be sufficiently reactive for the perhydrolysis reaction to occur within the optimum time frame (e.g., a wash cycle). However, if L is too reactive, this activator will be difficult to stabilize for use in a bleaching composition.

Preferred L groups are selected from the group consisting of:

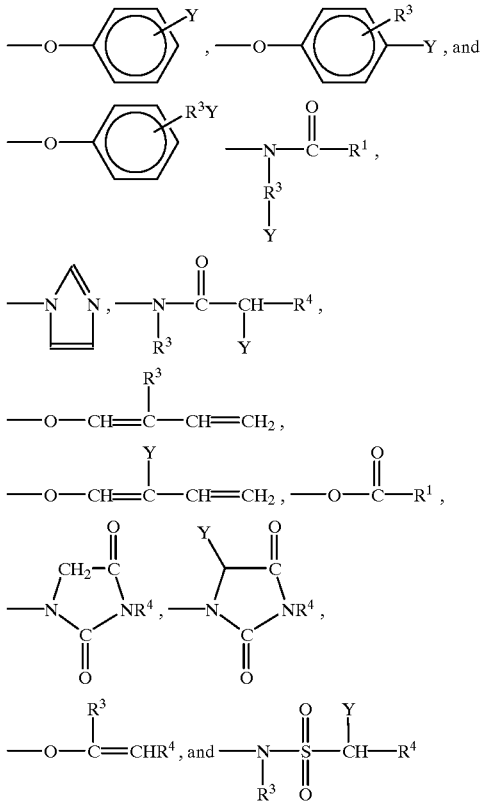

and mixtures thereof, wherein $R^1$ is an alkyl, aryl, or alkaryl group containing from 1 to 14 carbon atoms, $R^3$ is an alkyl chain containing from 1 to 8 carbon atoms, $R^4$ is H or $R^3$, and Y is H or a solubilizing group. Any of $R^1$, $R^3$ and $R^4$ my be substituted by essentially any functional group including, for example alkyl, hydroxy, alkoxy, halogen, amine, nitrosyl, amide and ammonium or alkyl ammonium groups.

The preferred solubilizing groups are $—SO_3^-M^+$, $—CO_2^-M^+$, $—SO_4^-M^+$, $—N^+(R^3)_4X^-$ and $O←N(R^3)_3$ and most preferably $—SO_3^-M^+$ and $—CO_2^-M^+$ wherein $R^3$ is an alkyl chain containing from 1 to 4 carbon atoms, M is a cation which provides solubility to the bleach activator and X is an anion which provides solubility to the bleach activator. Preferably, M is an alkali metal, ammonium or substituted ammonium cation, with sodium and potassium being most preferred, and X is a halide, hydroxide, methylsulfate or acetate anion.

Perbenzoic Acid Precursor

Perbenzoic acid precursor compounds provide perbenzoic acid on perhydrolysis.

Suitable O-acylated perbenzoic acid precursor compounds include the substituted and unsubstituted benzoyl oxybenzene sulfonates, including for example benzoyl oxybenzene sulfonate:

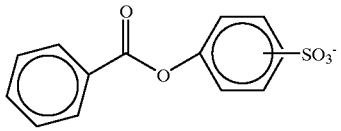

Also suitable are the benzoylation products of sorbitol, glucose, and all saccharides with benzoylating agents, including for example:

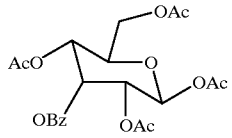

Ac = COCH3; Bz = Benzoyl

Perbenzoic acid precursor compounds of the imide type include N-benzoyl succinimide, tetrabenzoyl ethylene diamine and the N-benzoyl substituted ureas. Suitable imidazole type perbenzoic acid precursors include N-benzoyl imidazole and N-benzoyl benzimidazole and other useful N-acyl group-containing perbenzoic acid precursors include N-benzoyl pyrrolidone, dibenzoyl taurine and benzoyl pyroglutamic acid.

Other perbenzoic acid precursors include the benzoyl diacyl peroxides, the benzoyl tetraacyl peroxides, and the compound having the formula:

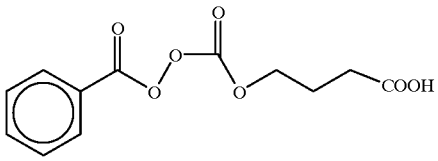

Phthalic anhydride is another suitable perbenzoic acid precursor compound herein:

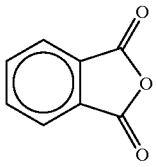

Suitable N-acylated lactam perbenzoic acid precursors have the formula:

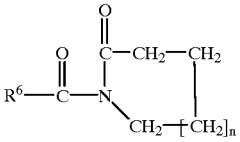

wherein n is from 0 to 8, preferably from 0 to 2, and $R^6$ is a benzoyl group.

Perbenzoic Acid Derivative Precursors

Perbenzoic acid derivative precursors provide substituted perbenzoic acids on perhydrolysis.

Suitable substituted perbenzoic acid derivative precursors include any of the herein disclosed perbenzoic precursors in which the benzoyl group is substituted by essentially any non-positively charged (i.e.; non-cationic) functional group including, for example alkyl, hydroxy, alkoxy, halogen, amine, nitrosyl and amide groups.

A preferred class of substituted perbenzoic acid precursor compounds are the amide substituted compounds of the following general formulae:

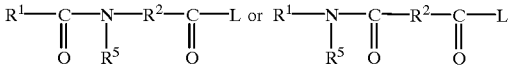

wherein $R^1$ is an aryl or alkaryl group with from 1 to 14 carbon atoms, $R^2$ is an arylene, or alkarylene group containing from 1 to 14 carbon atoms, and $R^5$ is H or an alkyl, aryl, or alkaryl group containing 1 to 10 carbon atoms and L can be essentially any leaving group. $R^1$ preferably contains from 6 to 12 carbon atoms. $R^2$ preferably contains from 4 to 8 carbon atoms. $R^1$ may be aryl, substituted aryl or alkylaryl containing branching, substitution, or both and may be sourced from either synthetic sources or natural sources including for example, tallow fat. Analogous structural variations are permissible for $R^2$. The substitution can include alkyl, aryl, halogen, nitrogen, sulphur and other typical substituent groups or organic compounds. $R^5$ is preferably H or methyl. $R^1$ and $R^5$ should not contain more than 18 carbon atoms in total. Amide substituted bleach activator compounds of this type are described in EP-A-0170386.

Cationic Peroxyacid Precursors

Cationic peroxyacid precursor compounds produce cationic peroxyacids on perhydrolysis.

Typically, cationic peroxyacid precursors are formed by substituting the peroxyacid part of a suitable peroxyacid precursor compound with a positively charged functional group, such as an ammonium or alkyl ammonium group, preferably an ethyl or methyl ammonium group.

Cationic peroxyacid precursors are typically present in the compositions as a salt with a suitable anion, such as for example a halide ion or a methylsulfate ion.

The peroxyacid precursor compound to be so cationically substituted may be a perbenzoic acid, or substituted derivative thereof, precursor compound as described hereinbefore. Alternatively, the peroxyacid precursor compound may be an alkyl percarboxylic acid precursor compound or an amide substituted alkyl peroxyacid precursor as described hereinafter.

Cationic peroxyacid precursors are described in U.S. Pat. Nos. 4,904,406; 4,751,015; 4,988,451; 4,397,757; 5,269,962; 5,127,852; 5,093,022; 5,106,528; U.K. 1,382,594; EP 475,512, 458,396 and 284,292; and in JP 87-318,332.

Suitable cationic peroxyacid precursors include any of the ammonium or alkyl ammonium substituted alkyl or benzoyl oxybenzene sulfonates, N-acylated caprolactams, and monobenzoyltetraacetyl glucose benzoyl peroxides.

A preferred cationically substituted benzoyl oxybenzene sulfonate is the 4-(trimethyl ammonium) methyl derivative of benzoyl oxybenzene sulfonate:

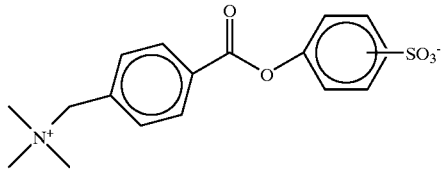

A preferred cationically substituted alkyl oxybenzene sulfonate has the formula:

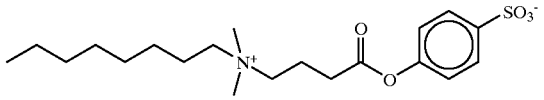

Preferred cationic peroxyacid precursors of the N-acylated caprolactam class include the trialkyl ammonium methylene benzoyl caprolactams, particularly trimethyl ammonium methylene benzoyl caprolactam:

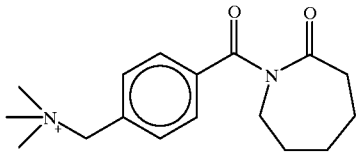

Other preferred cationic peroxyacid precursors of the N-acylated caprolactam class include the trialkyl ammonium methylene alkyl caprolactam:

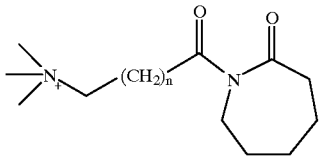

where n is from 0 to 12, particularly from 1 to 5.

Another preferred cationic peroxyacid precursor is 2-(N,N,N-trimethyl ammonium) ethyl sodium 4-sulphophenyl carbonate chloride.

Alkyl Percarboxylic Acid Bleach Precursors

Alkyl percarboxylic acid bleach precursors form percarboxylic acids on perhydrolysis. Preferred precursors of this type provide peracetic acid on perhydrolysis.

Preferred alkyl percarboxylic precursor compounds of the imide type include the N-,N,$N^1N^1$ tetra acetylated alkylene diamines wherein the alkylene group contains from 1 to 6 carbon atoms, particularly those compounds in which the alkylene group contains 1, 2 and 6 carbon atoms. Tetraacetyl ethylene diamine (TAED) is particularly preferred.

Other preferred alkyl percarboxylic acid precursors include sodium 3,5,5-tri-methyl hexanoyloxybenzene sulfonate (iso-NOBS), sodium nonanoyloxybenzene sulfonate (NOBS), sodium acetoxybenzene sulfonate (ABS) and penta acetyl glucose.

Amide Substituted Alkyl Peroxvacid Precursors

Amide substituted alkyl peroxyacid precursor compounds are also suitable, including those of the following general formulae:

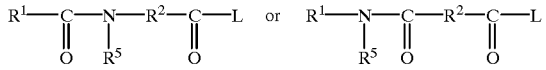

wherein $R^1$ is an alkyl group with from 1 to 14 carbon atoms, $R^2$ is an alkylene group containing from 1 to 14 carbon atoms, and $R^5$ is H or an alkyl group containing 1 to 10 carbon atoms and L can be essentially any leaving group. $R^1$ preferably contains from 6 to 12 carbon atoms. $R^2$ preferably contains from 4 to 8 carbon atoms. $R^1$ may be straight chain or branched alkyl containing branching, substitution, or both and may be sourced from either synthetic sources or natural sources including for example, tallow fat. Analogous structural variations are permissible for $R^2$. The substitution can include alkyl, halogen, nitrogen, sulphur and other typical substituent groups or organic compounds. $R^5$ is preferably H or methyl. $R^1$and $R^5$ should not contain more than 18 carbon atoms in total. Amide substituted bleach activator compounds of this type are described in EP-A-0170386.

Benzoxazin Organic Peroxyacid Precursors

Also suitable are precursor compounds of the benzoxazin-type, as disclosed for example in EP-A-332,294 and EP-A-482,807, particularly those having the formula:

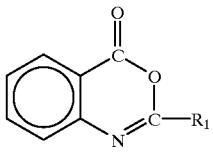

including the substituted benzoxazins of the type

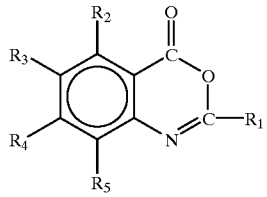

wherein $R_1$ is H, alkyl, alkaryl, aryl, arylalkyl, and wherein $R_2$, $R_3$, $R_4$, and $R_5$ may be the same or different substituents selected from H, halogen, alkyl, alkenyl, aryl, hydroxyl, alkoxyl, amino, alkyl amino, $COOR_6$ (wherein $R_6$ is H or an alkyl group) and carbonyl functions.

An especially preferred precursor of the benzoxazin-type is:

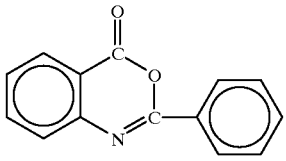

Preformed Organic Peroxvacid

The organic peroxyacid bleaching system may contain, in addition to, or as an alternative to, an organic peroxyacid bleach precursor compound, a preformed organic peroxyacid, typically at a level of from 0.5% to 25% by weight, more preferably from 1% to 10% by weight of the composition.

A preferred class of organic peroxyacid compounds are the amide substituted compounds of the following general formulae:

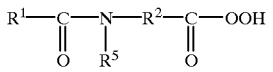

or

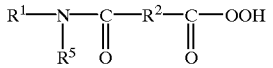

wherein $R^1$ is an alkyl, aryl or alkaryl group with from 1 to 14 carbon atoms, $R^2$ is an alkylene, arylene, and alkarylene group containing from 1 to 14 carbon atoms, and $R^5$ is H or an alkyl, aryl, or alkaryl group containing 1 to 10 carbon atoms. $R^1$ preferably contains from 6 to 12 carbon atoms. $R^2$ preferably contains from 4 to 8 carbon atoms. $R^1$ may be straight chain or branched alkyl, substituted aryl or alkylaryl containing branching, substitution, or both and may be sourced from either synthetic sources or natural sources including for example, tallow fat. Analogous structural variations are permissible for $R^2$. The substitution can include alkyl, aryl, halogen, nitrogen, sulphur and other typical substituent groups or organic compounds. $R^5$ is preferably H or methyl. $R^1$ and $R^5$ should not contain more than 18 carbon atoms in total. Amide substituted organic peroxyacid compounds of this type are described in EP-A-0170386.

Other organic peroxyacids include diacyl and tetraacylperoxides, especially diperoxydodecanedioc acid, diperoxytetradecanedioc acid, and diperoxyhexadecanedioc acid. Dibenzoyl peroxide is a preferred organic peroxyacid herein. Mono- and diperazelaic acid, mono- and diperbrassylic acid, and N-phthaloylaminoperoxicaproic acid are also suitable herein.

Inorganic Perhydrate Bleaches

The compositions in accord with the invention may include a second hydrogen peroxide source, as a further oxygen-releasing bleach. Suitable hydrogen peroxide sources include other inorganic perhydrate salts.

The inorganic perhydrate salts are normally incorporated in the form of the sodium salt at a level of from 1% to 40% by weight, more preferably from 2% to 30% by weight and most preferably from 5% to 25% by weight of the compositions.

Examples of other inorganic perhydrate salts include perborate, perphosphate, persulfate and persilicate salts. The inorganic perhydrate salts are normally the alkali metal salts. The inorganic perhydrate salt may be included as the crystalline solid without additional protection. For certain perhydrate salts however, the preferred executions of such granular compositions utilize a coated form of the material which provides better storage stability for the perhydrate salt in the granular product.

Sodium perborate can be in the form of the monohydrate of nominal formula $NaBO_2H_2O_2$ or the tetrahydrate $NaBO_2H_2O_2.3H_2O$.

Potassium peroxymonopersulfate is another inorganic perhydrate salt of utility in the compositions herein.

Metal-containing Bleach Catalyst

The bleach compositions described herein may additionally contain as a preferred component, a metal containing bleach catalyst. Preferably the metal containing bleach catalyst is a transition metal containing bleach catalyst, more preferably a manganese or cobalt-containing bleach catalyst.

A suitable type of bleach catalyst is a catalyst comprising a heavy metal cation of defined bleach catalytic activity, such as copper, iron cations, an auxiliary metal cation having little or no bleach catalytic activity, such as zinc or aluminum cations, and a sequestrant having defined stability constants for the catalytic and auxiliary metal cations, particularly ethylenediaminetetraacetic acid, ethylenediaminetetra(methylenephosphonic acid) and water-soluble salts thereof. Such catalysts are disclosed in U.S. Pat. No. 4,430,243.

Preferred types of bleach catalysts include the manganese-based complexes disclosed in U.S. Pat. No. 5,246,621 and U.S. Pat. No. 5,244,594. Preferred examples of these catalysts include $Mn^{IV}_2(u\text{-}O)_3$(1,4,7-trimethyl-1,4,7-triazacyclononane)$_2$-$(PF_6)_2$, $Mn^{III}_2(u\text{-}O)_1(u\text{-}OAc)_2$(1,4,7-trimethyl-1,4,7-triazacyclononane)$_2$-$(ClO_4)_2$, $Mn^{IV}_4(u\text{-}O)_6$(1,4,7-triazacyclononane)$_4$-$(ClO_4)_2$, $Mn^{III}Mn^{IV}_4(u\text{-}O)_1(u\text{-}OAc)_2$-(1,4,7-trimethyl-1,4,7-triazacyclononane)$_2$-$(ClO_4)_3$, and mixtures thereof. Others are described in European patent application publication no. 549,272. Other ligands suitable for use herein include 1,5,9-trimethyl-1,5,9-triazacyclododecane, 2-methyl-1,4,7-triazacyclononane, 2-methyl-1,4,7-triazacyclononane, 1,2,4,7-tetramethyl-1,4,7-triazacyclononane, and mixtures thereof.

The bleach catalysts useful in the compositions herein may also be selected as appropriate for the present invention. For examples of suitable bleach catalysts see U.S. Pat. No. 4,246,612 and U.S. Pat. No. 5,227,084. See also U.S. Pat. No. 5,194,416 which teaches mononuclear manganese (IV) complexes such as Mn(1,4,7-trimethyl-1,4,7-triazacyclononane)$(OCH_3)_3$-$(PF_6)$.

Still another type of bleach catalyst, as disclosed in U.S. Pat. No. 5,114,606, is a water-soluble complex of manganese (III), and/or (IV) with a ligand which is a non-carboxylate polyhydroxy compound having at least three consecutive C—OH groups. Preferred ligands include sorbitol, iditol, dulsitol, mannitol, xylithol, arabitol, adonitol, meso-erythritol, meso-inositol, lactose, and mixtures thereof.

U.S. Pat. No. 5,114,611 teaches a bleach catalyst comprising a complex of transition metals, including Mn, Co, Fe, or Cu, with an non-(macro)-cyclic ligand. Said ligands are of the formula:

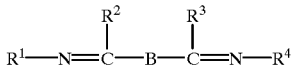

wherein $R^1$, $R^2$, $R^3$, and $R^4$ can each be selected from H, substituted alkyl and aryl groups such that each $R^1$—N═C—$R^2$ and $R^3$—C═N—$R^4$ form a five or six-membered ring. Said ring can further be substituted. B is a bridging group selected from O, S. $CR^5R^6$, $NR^7$ and C═O, wherein $R^5$, $R^6$, and $R^7$ can each be H, alkyl, or aryl groups, including substituted or unsubstituted groups. Preferred ligands include pyridine, pyridazine, pyrimidine, pyrazine, imidazole, pyrazole, and triazole rings. Optionally, said rings may be substituted with substituents such as alkyl, aryl, alkoxy, halide, and nitro. Particularly preferred is the ligand 2,2'-bispyridylamine. Preferred bleach catalysts include Co, Cu, Mn, Fe,-bispyridylmethane and -bispyridylamine complexes. Highly preferred catalysts include Co(2,2'-bispyridylamine)$Cl_2$, Di(isothiocyanato) bispyridylamine-cobalt (II), trisdipyridylamine-cobalt(II) perchlorate, Co(2,2-bispyridylamine)$_2O_2ClO_4$, Bis-(2,2'- bispyridylamine) copper(II) perchlorate, tris(di-2-pyridylamine) iron(II) perchlorate, and mixtures thereof.

Preferred examples include binuclear Mn complexes with tetra-N-dentate and bi-N-dentate ligands, including $N_4Mn^{III}(u\text{-}O)_2Mn^{IV}N_4)^+$ and $[Bipy_2Mn^{III}(u\text{-}O)_2Mn^{IV}bipy_2]\text{-}(ClO_4)_3$.

While the structures of the bleach-catalyzing manganese complexes of the present invention have not been elucidated, it may be speculated that they comprise chelates or other hydrated coordination complexes which result from the interaction of the carboxyl and nitrogen atoms of the ligand with the manganese cation. Likewise, the oxidation state of the manganese cation during the catalytic process is not known with certainty, and may be the (+II), (+III), (+IV) or (+V) valence state. Due to the ligands' possible six points of attachment to the manganese cation, it may be reasonably speculated that multi-nuclear species and/or "cage" structures may exist in the aqueous bleaching media. Whatever the form of the active Mn.ligand species which actually exists, it functions in an apparently catalytic manner to provide improved bleaching performances on stubborn stains such as tea, ketchup, coffee, wine, juice, and the like.

Other bleach catalysts are described, for example, in European patent application, publication no. 408,131 (cobalt complex catalysts), European patent applications, publication nos. 384,503, and 306,089 (metallo-porphyrin catalysts), U.S. Pat. No. 4,728,455 (manganese/multidentate ligand catalyst), U.S. Pat. No. 4,711,748 and European patent application, publication no. 224,952, (absorbed manganese on aluminosilicate catalyst), U.S. Pat. No. 4,601,845 (aluminosilicate support with manganese and zinc or magnesium salt), U.S. Pat. No. 4,626,373 (manganese/ligand catalyst), U.S. Pat. No. 4,119,557 (ferric complex catalyst), German Pat. specification 2,054,019 (cobalt chelant catalyst) Canadian 866,191 (transition metal-containing salts), U.S. Pat. No. 4,430,243 (chelants with manganese cations and non-catalytic metal cations), and U.S. Pat. No. 4,728,455 (manganese gluconate catalysts).

Other preferred examples include cobalt (III) catalysts having the formula:

$$Co[(NH_3)_nM'_mB'_bT'_tQ_qP_p]Yy$$

wherein cobalt is in the +3 oxidation state; n is an integer from 0 to 5 (preferably 4 or 5; most preferably 5); M' represents a monodentate ligand; m is an integer from 0 to 5 (preferably 1 or 2; most preferably 1); B' represents a bidentate ligand; b is an integer from 0 to 2; T' represents a tridentate ligand; t is 0 or 1; Q is a tetradentate ligand; q is 0 or 1; P is a pentadentate ligand; p is 0 or −1; and n+m+2b+3t+4q+5p=6; Y is one or more appropriately selected counteranions present in a number y, where y is an integer from 1 to 3 (preferably 2 to 3; most preferably 2 when Y is a −1 charged anion), to obtain a charge-balanced salt, preferred Y are selected from the group consisting of chloride, nitrate, nitrite, sulfate, citrate, acetate, carbonate, and combinations thereof; and wherein further at least one of the coordination sites attached to the cobalt is labile under automatic dishwashing use conditions and the remaining coordination sites stabilize the cobalt under automatic dishwashing conditions such that the reduction potential for cobalt (III) to cobalt (II) under alkaline conditions is less than about 0.4 volts (preferably less than about 0.2 volts) versus a normal hydrogen electrode.

Preferred cobalt catalysts of this type have the formula:

$$[Co(NH_3)_n(M')_m]Y_y$$

wherein n is an integer from 3 to 5 (preferably 4 or 5; most preferably 5); M' is a labile coordinating moiety, preferably selected from the group consisting of chlorine, bromine, hydroxide, water, and (when m is greater than 1) combinations thereof; m is an integer from 1 to 3 (preferably 1 or 2; most preferably 1); m+n=6; and Y is an appropriately selected counteranion present in a number y, which is an integer from 1 to 3 (preferably 2 to 3; most preferably 2 when Y is a −1 charged anion), to obtain a charge-balanced salt.

The preferred cobalt catalyst of this type useful herein are cobalt pentaamine chloride salts having the formula $[Co(NH_3)_5Cl]Y_y$, and especially $[Co(NH_3)_5Cl]Cl_2$.

More preferred are the present invention compositions which utilize cobalt (III) bleach catalysts having the formula:

$$[Co(NH_3)_n(M)_m(B)_b]T_y$$

wherein cobalt is in the +3 oxidation state; n is 4 or 5 (preferably 5); M is one or more ligands coordinated to the cobalt by one site; m is 0, 1 or 2 (preferably 1); B is a ligand coordinated to the cobalt by two sites; b is 0 or 1 (preferably 0), and when b=0, then m+n=6, and when b=1, then m=0 and n=4; and T is one or more appropriately selected counteranions present in a number y, where y is an integer to obtain a charge-balanced salt (preferably y is 1 to 3; most preferably 2 when T is a −1 charged anion); and wherein further said catalyst has a base hydrolysis rate constant of less than 0.23 $M^{-1}\ s^{-1}$ (25° C.).

Preferred T are selected from the group consisting of chloride, iodide, $I_3$-, formate, nitrate, nitrite, sulfate, sulfite, citrate, acetate, carbonate, bromide, $PF_6$-, $BF_4$-, $B(Ph)_4$-, phosphate, phosphite, silicate, tosylate, methanesulfonate, and combinations thereof. Optionally, T can be protonated if more than one anionic group exists in T, e.g., $HPO_4^{2}$-, $HCO_3$-, $H_2PO_4$-, etc. Further, T may be selected from the group consisting of non-traditional inorganic anions such as anionic surfactants (e.g., linear alkylbenzene sulfonates (LAS), alkyl sulfates (AS), alkylethoxysulfonates (AES), etc.) and/or anionic polymers (e.g., polyacrylates, polymethacrylates, etc.).

The M moieties include, but are not limited to, for example, F-, $SO_4$-$^{2}$, NCS-, SCN-, $S_2O_3$-$^{2}$, $NH_3$, $PO_4^{3}$-, and carboxylates (which preferably are mono-carboxylates, but more than one carboxylate may be present in the moiety as long as the binding to the cobalt is by only one carboxylate per moiety, in which case the other carboxylate in the M moiety may be protonated or in its salt form). Optionally, M can be protonated if more than one anionic group exists in M (e.g., $HPO_4^{2}$-, $HCO_3$-, $H_2PO_4$-, $HOC(O)CH_2C(O)O$—, etc.) Preferred M moieties are substituted and unsubstituted $C_1$–$C_{30}$ carboxylic acids having the formulas:

$$RC(O)O—$$

wherein R is preferably selected from the group consisting of hydrogen and $C_1$–$C_{30}$ (preferably $C_1$–$C_{18}$) unsubstituted and substituted alkyl, $C_6$–$C_{30}$ (preferably $C_6$–$C_{18}$) unsubstituted and substituted aryl, and $C_3$–$C_{30}$ (preferably $C_5$–$C_{18}$) unsubstituted and substituted heteroaryl, wherein substituents are selected from the group consisting of —$NR'_3$, —$NR'^{+}_4$, —C(O)OR', —OR', —$C(O)NR'_2$, wherein R' is selected from the group consisting of hydrogen and $C_1$–$C_6$ moieties. Such substituted R therefore include the moieties —$(CH_2)_nOH$ and —$(CH_2)_nNR'^{+}_4$, wherein n is an integer from 1 to about 16, preferably from about 2 to about 10, and most preferably from about 2 to about 5.

Most preferred M are carboxylic acids having the formula above wherein R is selected from the group consisting of hydrogen, methyl, ethyl, propyl, straight or branched $C_4$–$C_{12}$ alkyl, and benzyl. Most preferred R is methyl. Preferred carboxylic acid M moieties include formic, benzoic, octanoic, nonanoic, decanoic, dodecanoic, malonic, maleic, succinic, adipic, phthalic, 2-ethylhexanoic, naphthenoic, oleic, palmitic, triflate, tartrate, stearic, butyric, citric, acrylic, aspartic, fumaric, lauric, linoleic, lactic, malic, and especially acetic acid.

The B moieties include carbonate, di- and higher carboxylates (e.g., oxalate, malonate, malic, succinate, maleate), picolinic acid, and alpha and beta amino acids (e.g., glycine, alanine, beta-alanine, phenylalanine).

Cobalt bleach catalysts useful herein are known, being described for example along with their base hydrolysis rates, in M. L. Tobe, "Base Hydrolysis of Transition-Metal Complexes", *Adv. Inorg. Bioinorg. Mech.,* (1983), 2, pages 1–94. For example, Table 1 at page 17, provides the base hydrolysis rates (designated therein as $k_{OH}$) for cobalt pentaamine catalysts complexed with oxalate ($k_{OH}$=2.5×$10^{-4}$ $M^{-1}$ $s^{-1}$ (25° C.)), NCS- ($k_{OH}$=5.0×$10^{-4}$ $M^{-1}$ $s^{-1}$ (25° C.)), formate ($k_{OH}$=5.8×$10^{-4}$ $M^{-1}$ $s^{-1}$ (25° C.)), and acetate ($k_{OH}$=9.6×$10^{-4}$ $M^{-1}$ $s^{-1}$ (25° C.)). The most preferred cobalt catalyst useful herein are cobalt pentaamine acetate salts having the formula $[Co(NH_3)_5OAc]T_y$, wherein OAc represents an acetate moiety, and especially cobalt pentaamine acetate chloride, $[Co(NH_3)_5OAc]Cl_2$; as well as $[Co(NH_3)_5OAc](OAc)_2$; $[Co(NH_3)_5OAc](PF_6)_2$; $[Co(NH_3)_5OAc](SO_4)$; $[Co\text{-}(NH_3)_5OAc](BF_4)_2$; and $[Co(NH_3)_5OAc](NO_3)_2$ (herein "PAC").

These cobalt catalysts are readily prepared by known procedures, such as taught for example in the Tobe article hereinbefore and the references cited therein, in U.S. Pat. No. 4,810,410, to Diakun et al, issued Mar. 7, 1989, *J. Chem. Ed.* (1989), 66 (12), 1043–45; The Synthesis and Characterization of Inorganic Compounds, W. L. Jolly (Prentice-Hall; 1970), pp. 461–3; *Inorg. Chem.,* 18, 1497–1502 (1979); *Inorg. Chem.,* 21, 2881–2885 (1982); *Inorg. Chem.,* 18, 2023–2025 (1979); *Inorg. Synthesis,* 173–176 (1960); and *Journal of Physical Chemistry,* 56, 22–25 (1952); as well as the synthesis examples provided hereinafter.

These catalysts may be coprocessed with adjunct materials so as to reduce the color impact if desired for the aesthetics of the product, or to be included in enzyme-containing particles as exemplified hereinafter, or the compositions may be manufactured to contain catalyst "speckles".

Amino Tricarboxylic Acid (ATCA)

The amino tricarboxylic acid (ATCA) is selected from the group having the general formula as shown below.

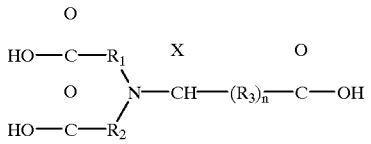

where $R_1$, $R_2$ and $R_3$ are an alkyl group or substituted alkyl group of chain length C1 to C4, and n is 0 or 1. X is an organic substitutent group, that is a substituent typically encountered in organic compounds, but excluding X being a hydrogen substituent. X can thus for example be an alkyl, aryl, alkenyl or alkaryl group optionally substituted by any functionality including for example, amino, hydroxyl, amide and ether functionalities. X may also be an organic functional group including for example an amine, hydroxyl, amide, ester or ether group. X is preferably an alkyl group, most preferably a methyl or ethyl group. ATCA is most preferably methyl glycine diacetic acid, that is where $R_1$=$R_2$=a —$CH_2$— group, n is 0 and X=$CH_3$.

ATCA can be present at levels of greater than 0.0001% by weight, preferably from 0.001% to 40% by weight, most preferably from 0.1% to 15% by weight of detergent composition. The weight ratio of percarbonate bleach compound to ATCA is preferably from 500:1 to 1:1, more preferably from 200:1 to 5:1, most preferably from 100:1 to 10:1.

ATCA acts as a cation complexing chelant. ATCA forms water-soluble chelates with calcium, magnesium, lead, copper, zinc, cadmium, mercury, manganese, iron, aluminium and other cationic polyvalent ions. The stability constant (measured as log $K_{MeZ}$) of ATCA-calcium chelate is greater than 5.0, preferably greater then 6.0. The stability constant of the preferred ATCA compound, methyl glycine diacetic acid (MGDA) is 7.0. The stability constant, log $K_{MeZ}$ is measured in a solution of ionic strength of 0.1, at a temperature of 25° C. The figure of >5.0 for $\log K_{MeZ}$ indicates that the ratio of the concentration of the undissociated $[CaATCA^-]$ to the dissociated complex $[Ca^{2+}][ATCA^{3-}]$, is >$10^5$:1.

Optional Detergent Components

The bleaching compositions herein are preferably incorporated within detergent compositions which may contain various components including surfactants, alkalinity sources, water-soluble builder compounds, lime soap dispersants, organic polymeric compounds including polymeric dye transfer inhibiting agents, crystal growth inhibitors, heavy metal ion sequestrants, enzymes and enzyme stabilisers, corrosion inhibitors, suds suppressors, solvents, fabric softening agents, optical brighteners and hydrotropes.

Surfactant

A highly preferred component of the compositions used in this invention is a surfactant system comprising surfactant selected from anionic, cationic, nonionic ampholytic and zwitterionic surfactants and mixtures thereof. Automatic dishwashing machine products should be low foaming in character and thus the foaming of the surfactant system must be suppressed or more preferably be low foaming, typically nonionic in character. The surfactant system is typically present at a level of from 0.2% to 30% by weight, more preferably from 0.5% to 10% by weight, most preferably from 1% to 5% by weight of the compositions.

A typical listing of anionic, nonionic, ampholytic and zwitterionic classes, and species of these surfactants, is given in U.S. Pat. No. 3,929,678 issued to Laughlin and Heuring on Dec. 30, 1975. A list of suitable cationic surfactants is given in U.S. Pat. No. 4,259,217 issued to Murphy on Mar. 31, 1981. A listing of surfactants typically included in automatic dishwashing detergent compositions is given for example, in EP-A-0414 549 and PCT Applications Nos. WO 93/08876 and WO 93/08874.

Nonionic Surfactant

Essentially any nonionic surfactants useful for detersive purposes can be included in the compositions. Preferred, non-limiting classes of useful nonionic surfactants are listed below.

Nonionic Ethoxylated Alcohol Surfactant

The alkyl ethoxylate condensation products of aliphatic alcohols with from about 1 to about 25 moles of ethylene oxide are suitable for use herein. The alkyl chain of the aliphatic alcohol can either be straight or branched, primary or secondary, and generally contains from 6 to 22 carbon atoms. Particularly preferred are the condensation products of alcohols having an alkyl group containing from 8 to 20 carbon atoms with from about 2 to about 10 moles of ethylene oxide per mole of alcohol.

Nonionic Ethoxylated/propoxylated Fatty Alcohol Surfactant

The ethoxylated $C_6$–$C_{18}$ fatty alcohols and $C_6$–$C_{18}$ mixed ethoxylated/propoxylated fatty alcohols are suitable surfactants for use herein, particularly where water soluble. Preferably the ethoxylated fatty alcohols are the $C_{10}$–$C_{18}$ ethoxylated fatty alcohols with a degree of ethoxylation of from 3 to 50, most preferably these are the $C_{12}$–$C_{18}$ ethoxylated fatty alcohols with a degree of ethoxylation from 3 to 40. Preferably the mixed ethoxylated/propoxylated fatty alcohols have an alkyl chain length of from 10 to 18 carbon atoms, a degree of ethoxylation of from 3 to 30 and a degree of propoxylation of from 1 to 10.

Nonionic EO/PO Condensates with Propylene Glycol

The condensation products of ethylene oxide with a hydrophobic base formed by the condensation of propylene oxide with propylene glycol are suitable for use herein. The hydrophobic portion of these compounds preferably has a molecular weight of from about 1500 to about 1800 and exhibits water insolubility. Examples of compounds of this type include certain of the commercially-available Pluronic™ surfactants, marketed by BASF.

Nonionic EO Condensation Products with Propylene Oxide/ethylene Diamine Adducts

The condensation products of ethylene oxide with the product resulting from the reaction of propylene oxide and ethylenediamine are suitable for use herein. The hydrophobic moiety of these products consists of the reaction product of ethylenediamine and excess propylene oxide, and generally has a molecular weight of from about 2500 to about 3000. Examples of this type of nonionic surfactant include certain of the commercially available Tetronic™ compounds, marketed by BASF.

Anionic Surfactant

Essentially any anionic surfactants useful for detersive purposes are suitable. These can include salts (including, for example, sodium, potassium, ammonium, and substituted ammonium salts such as mono-, di- and triethanolamine salts) of the anionic sulfate, sulfonate, carboxylate and sarcosinate surfactants. Anionic sulfate surfactants are preferred.

Other anionic surfactants include the isethionates such as the acyl isethionates, N-acyl taurates, fatty acid amides of methyl tauride, alkyl succinates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters), N-acyl sarcosinates. Resin acids and hydrogenated resin acids are also suitable, such as rosin, hydrogenated rosin, and resin acids and hydrogenated resin acids present in or derived from tallow oil.

Anionic Sulfate Surfactant

Anionic sulfate surfactants suitable for use herein include the linear and branched primary and secondary alkyl sulfates, alkyl ethoxysulfates, fatty oleoyl glycerol sulfates, alkyl phenol ethylene oxide ether sulfates, the $C_5$–$C_{17}$ acyl-N—($C_1$–$C_4$ alkyl) and —N—($C_1$–$C_2$ hydroxyalkyl) glucamine sulfates, and sulfates of alkylpolysaccharides such as the sulfates of alkylpolyglucoside (the nonionic nonsulfated compounds being described herein).

Alkyl sulfate surfactants are preferably selected from the linear and branched primary $C_{10}$–$C_{18}$ alkyl sulfates, more preferably the $C_{11}$–$C_{15}$ branched chain alkyl sulfates and the $C_{12}$–$C_{14}$ linear chain alkyl sulfates.

Alkyl ethoxysulfate surfactants are preferably selected from the group consisting of the $C_{10}$–$C_{18}$ alkyl sulfates which have been ethoxylated with from 0.5 to 20 moles of ethylene oxide per molecule. More preferably, the alkyl ethoxysulfate surfactant is a $C_{11}$–$C_{18}$, most preferably $C_{11}$–$C_{15}$ alkyl sulfate which has been ethoxylated with from 0.5 to 7, preferably from 1 to 5, moles of ethylene oxide per molecule.

A particularly preferred aspect of the invention employs mixtures of the preferred alkyl sulfate and alkyl ethoxysulfate surfactants. Such mixtures have been disclosed in PCT Patent Application No. WO 93/18124.

Anionic Sulfonate Surfactant

Anionic sulfonate surfactants suitable for use herein include the salts of $C_5$–$C_{20}$ linear alkylbenzene sulfonates, alkyl ester sulfonates, $C_6$–$C_{22}$ primary or secondary alkane sulfonates, $C_6$–$C_{24}$ olefin sulfonates, sulfonated polycarboxylic acids, alkyl glycerol sulfonates, fatty acyl glycerol sulfonates, fatty oleyl glycerol sulfonates, and any mixtures thereof.

Anionic Carboxylate Surfactant

Suitable anionic carboxylate surfactants include the alkyl ethoxy carboxylates, the alkyl polyethoxy polycarboxylate surfactants and the soaps ('alkyl carboxyls'), especially certain secondary soaps as described herein.

Suitable alkyl ethoxy carboxylates include those with the formula $RO(CH_2CH_20)_x\ CH_2C00^{-M+}$ wherein R is a $C_6$ to $C_{18}$ alkyl group, x ranges from 0 to 10, and the ethoxylate distribution is such that, on a weight basis, the amount of material where x is 0 is less than 20% and M is a cation. Suitable alkyl polyethoxy polycarboxylate surfactants include those having the formula RO—($CHR_1$—$CHR_2$—O)—$R_3$ wherein R is a $C_6$ to $C_{18}$ alkyl group, x is from 1 to 25, $R_1$ and $R_2$ are selected from the group consisting of hydrogen, methyl acid radical, succinic acid radical, hydroxysuccinic acid radical, and mixtures thereof, and $R_3$ is selected from the group consisting of hydrogen, substituted or unsubstituted hydrocarbon having between 1 and 8 carbon atoms, and mixtures thereof.

Suitable soap surfactants include the secondary soap surfactants which contain a carboxyl unit connected to a secondary carbon. Preferred secondary soap surfactants for use herein are water-soluble members selected from the group consisting of the water-soluble salts of 2-methyl-1-undecanoic acid, 2-ethyl-1-decanoic acid, 2-propyl-1-nonanoic acid, 2-butyl-1-octanoic acid and 2-pentyl-1-heptanoic acid. Certain soaps may also be included as suds suppressors.

Alkali Metal Sarcosinate Surfactant

Other suitable anionic surfactants are the alkali metal sarcosinates of formula R—CON ($R^1$) $CH_2$ COOM, wherein R is a $C_5$–$C_{17}$ linear or branched alkyl or alkenyl group, $R^1$ is a $C_1$–$C_4$ alkyl group and M is an alkali metal ion. Preferred examples are the myristyl and oleoyl methyl sarcosinates in the form of their sodium salts.

Water-soluble Builder Compound

The compositions of the present invention may contain as a highly preferred component a water-soluble builder compound, typically present at a level of from 1% to 80% by weight, preferably from 10% to 70% by weight, most preferably from 20% to 60% by weight of the composition.

The compositions used in accord with this invention may optionally contain an additional builder compound. Suitable water-soluble builder compounds include the water soluble monomeric polycarboxylates, or their acid forms, homo or copolymeric polycarboxylic acids or their salts in which the polycarboxylic acid comprises at least two carboxylic radicals separated from each other by not more that two carbon atoms, carbonates, bicarbonates, borates, phosphates, and mixtures thereof.

The carboxylate or polycarboxylate builder can be monomeric or oligomeric in type although monomeric polycarboxylates are generally preferred for reasons of cost and performance.

Suitable carboxylates containing one carboxy group include the water soluble salts of lactic acid, glycolic acid and ether derivatives thereof. Polycarboxylates containing two carboxy groups include the water-soluble salts of succinic acid, malonic acid, (ethylenedioxy) diacetic acid, maleic acid, diglycolic acid, tartaric acid, tartronic acid and fumaric acid, as well as the ether carboxylates and the sulfinyl carboxylates. Polycarboxylates containing three carboxy groups include, in particular, water-soluble citrates, aconitrates and citraconates as well as succinate derivatives such as the carboxymethyloxysuccinates described in British Patent No. 1,379,241, lactoxysuccinates described in British Patent No. 1,389,732, and aminosuccinates described in Netherlands Application 7205873, and the oxypolycarboxylate materials such as 2-oxa-1,1,3-propane tricarboxylates described in British Patent No. 1,387,447.

Polycarboxylates containing four carboxy groups include oxydisuccinates disclosed in British Patent No. 1,261,829, 1,1,2,2-ethane tetracarboxylates, 1,1,3,3-propane tetracarboxylates and 1,1,2,3-propane tetracarboxylates. Polycarboxylates containing sulfo substituents include the sulfosuccinate derivatives disclosed in British Patent Nos. 1,398,421 and 1,398,422 and in U.S. Pat. No. 3,936,448, and the sulfonated pyrolysed citrates described in British Patent No. 1,439,000.

Alicyclic and heterocyclic polycarboxylates include cyclopentane-cis, cis, cis-tetracarboxylates, cyclopentadienide pentacarboxylates, 2,3,4,5-tetrahydrofuran-cis, cis, cis-tetracarboxylates, 2,5-tetrahydrofuran-cis-dicarboxylates, 2,2,5,5-tetrahydrofuran-tetracarboxylates, 1,2,3,4,5,6-hexane-hexacarboxylates and carboxymethyl derivatives of polyhydric alcohols such as sorbitol, mannitol and xylitol. Aromatic polycarboxylates include mellitic acid, pyromellitic acid and the phthalic acid derivatives disclosed in British Patent No. 1,425,343.

Of the above, the preferred polycarboxylates are hydroxycarboxylates containing up to three carboxy groups per molecule, more particularly citrates.

The parent acids of the monomeric or oligomeric polycarboxylate chelating agents or mixtures thereof with their salts, e.g. citric acid or citrate/citric acid mixtures are also contemplated as useful builder components.

Borate builders, as well as builders containing borate-forming materials that can produce borate under detergent storage or wash conditions can also be used but are not preferred at wash conditions less that about 50° C., especially less than about 40° C.

Examples of carbonate builders are the alkaline earth and alkali metal carbonates, including sodium carbonate and sesqui-carbonate and mixtures thereof with ultra-fine calcium carbonate as disclosed in German Patent Application No. 2,321,001 published on Nov. 15, 1973.

Specific examples of water-soluble phosphate builders are the alkali metal tripolyphosphates, sodium, potassium and ammonium pyrophosphate, sodium and potassium and ammonium pyrophosphate, sodium and potassium orthophosphate, sodium polymeta/phosphate in which the degree of polymerization ranges from about 6 to 21, and salts of phytic acid.

Partially Soluble or Insoluble Builder Compound

The detergent compositions of the present invention may contain a partially soluble or insoluble builder compound, typically present at a level of from 1% to 80% by weight, preferably from 10% to 70% by weight, most preferably from 20% to 60% weight of the composition.

Examples of largely water insoluble builders include the sodium aluminosilicates.

Suitable aluminosilicate zeolites have the unit cell formula $Na_z[(AlO_2)_z(SiO_2)y]. xH_2O$ wherein z and y are at least 6; the molar ratio of z to y is from 1.0 to 0.5 and x is at least 5, preferably from 7.5 to 276, more preferably from 10 to 264. The aluminosilicate material are in hydrated form and are preferably crystalline, containing from 10% to 28%, more preferably from 18% to 22% water in bound form.

The aluminosilicate zeolites can be naturally occurring materials, but are preferably synthetically derived. Synthetic crystalline aluminosilicate ion exchange materials are available under the designations Zeolite A, Zeolite B, Zeolite P, Zeolite X, Zeolite HS and mixtures thereof. Zeolite A has the formula $$Na_{12}[AlO_2)_{12}(SiO_2)_{12}]. xH_2O$$

wherein x is from 20 to 30, especially 27. Zeolite X has the formula $Na_{86}[(AlO_2)_{86}(SiO_2)_{106}]. 276 H_2O$.

Water-soluble Bismuth Compound

The compositions used in this invention may contain a water-soluble bismuth compound, preferably present at a level of from 0.005% to 20%, more preferably from 0.01% to 5%, most preferably from 0.1% to 1% by weight of the compositions.

The water-soluble bismuth compound may be essentially any salt or complex of bismuth with essentially any inorganic or organic counter anion. Preferred inorganic bismuth salts are selected from the bismuth trihalides, bismuth nitrate and bismuth phosphate. Bismuth acetate and citrate are preferred salts with an organic counter anion.

Water-soluble Sulfate Salt

The compositions may optionally contain a water-soluble sulfate salt, preferably present at a level of from 0.1% to 40%, more preferably from 1% to 30%, most preferably from 5% to 25% by weight of the compositions.

The water-soluble sulfate salt may be essentially any salt of sulfate with any counter cation. Preferred salts are selected from the sulfates of the alkali and alkaline earth metals, particularly sodium sulfate.

Corrosion Inhibitor Compound

The compositions may contain corrosion inhibitors preferably selected from organic silver coating agents, particularly paraffin, nitrogen-containing corrosion inhibitor compounds and Mn(II) compounds, particularly Mn(II) salts of organic ligands.

Organic silver coating agents are described in PCT Publication No. WO94/16047 and copending UK Application No. UK 9413729.6. Nitrogen-containing corrosion inhibitor compounds are disclosed in copending European Application no. EP 93202095.1. Mn(II) compounds for use in corrosion inhibition are described in copending UK Application No. 9418567.5.

Organic Silver Coating Agents

Organic silver coating agent may be incorporated at a level of from 0.05% to 10%, preferably from 0.1% to 5% by weight of the total composition.

The functional role of the silver coating agent is to form 'in use' a protective coating layer on any silverware components of the washload to which the compositions of the invention are being applied. The silver coating agent should hence have a high affinity for attachment to solid silver surfaces, particularly when present in as a component of an aqueous washing and bleaching solution with which the solid silver surfaces are being treated.

Suitable organic silver coating agents herein include fatty esters of mono- or polyhydric alcohols having from 1 to about 40 carbon atoms in the hydrocarbon chain.

The fatty acid portion of the fatty ester can be obtained from mono- or poly-carboxylic acids having from 1 to about 40 carbon atoms in the hydrocarbon chain. Suitable examples of monocarboxylic fatty acids include behenic acid, stearic acid, oleic acid, palmitic acid, myristic acid, lauric acid, acetic acid, propionic acid, butyric acid, isobutyric acid, Valerie acid, lactic acid, glycolic acid and β,β'-dihydroxyisobutyric acid. Examples of suitable polycarboxylic acids include: n-butyl-malonic acid, isocitric acid, citric acid, maleic acid, malic acid and succinic acid.

The fatty alcohol radical in the fatty ester can be represented by mono- or polyhydric alcohols having from 1 to 40 carbon atoms in the hydrocarbon chain. Examples of suitable fatty alcohols include; behenyl, arachidyl, cocoyl, oleyl and lauryl alcohol, ethylene glycol, glycerol, ethanol, isopropanol, vinyl alcohol, diglycerol, xylitol, sucrose, erythritol, pentaerythritol, sorbitol or sorbitan.

Preferably, the fatty acid and/or fatty alcohol group of the fatty ester adjunct material have from 1 to 24 carbon atoms in the alkyl chain.

Preferred fatty esters herein are ethylene glycol, glycerol and sorbitan esters wherein the fatty acid portion of the ester normally comprises a species selected from behenic acid, stearic acid, oleic acid, palmitic acid or myristic acid.

The glycerol esters are also highly preferred. These are the mono-, di- or tri-esters of glycerol and the fatty acids as defined above.

Specific examples of fatty alcohol esters for use herein include: stearyl acetate, palmityl di-lactate, cocoyl isobutyrate, oleyl maleate, oleyl dimaleate, and tallowyl proprionate. Fatty acid esters useful herein include: xylitol monopalmitate, pentaerythritol monostearate, sucrose monostearate, glycerol monostearate, ethylene glycol monostearate, sorbitan esters. Suitable sorbitan esters include sorbitan monostearate, sorbitan palmitate, sorbitan monolaurate, sorbitan monomyristate, sorbitan monobehenate, sorbitan mono-oleate, sorbitan dilaurate, sorbitan distearate, sorbitan dibehenate, sorbitan dioleate, and also mixed tallowalkyl sorbitan mono- and di-esters.

Glycerol monostearate, glycerol mono-oleate, glycerol monopalmitate, glycerol monobehenate, and glycerol distearate are preferred glycerol esters herein.

Suitable organic silver coating agents include triglycerides, mono or diglycerides, and wholly or partially hydrogenated derivatives thereof, and any mixtures thereof. Suitable sources of fatty acid esters include vegetable and fish oils and animal fats. Suitable vegetable oils include soy bean oil, cotton seed oil, castor oil, olive oil, peanut oil, safflower oil, sunflower oil, rapeseed oil, grapeseed oil, palm oil and corn oil.

Waxes, including microcrystalline waxes are suitable organic silver coating agents herein. Preferred waxes have a melting point in the range from about 35° C. to about 110° C. and comprise generally from 12 to 70 carbon atoms. Preferred are petroleum waxes of the paraffin and microcrystalline type which are composed of long-chain saturated hydrocarbon compounds.

Alginates and gelatin are suitable organic silver coating agents herein.

Dialkyl amine oxides such as $C_{12}$–$C_{20}$ methylamine oxide, and dialkyl quaternary ammonium compounds and salts, such as the $C_{12}$–$C_{20}$ methylammonium halides are also suitable.

Other suitable organic silver coating agents include certain polymeric materials. Polyvinylpyrrolidones with an average molecular weight of from 12,000 to 700,000, polyethylene glycols (PEG) with an average molecular weight of from 600 to 10,000, polyamine N-oxide polymers, copolymers of N-vinylpyrrolidone and N-vinylimidazole, and cellulose derivatives such as methylcellulose, carboxymethylcellulose and hydroxyethylcellulose are examples of such polymeric materials.

Certain perfume materials, particularly those demonstrating a high substantivity for metallic surfaces, are also useful as the organic silver coating agents herein.

Polymeric soil release agents can also be used as an organic silver coating agent.

Suitable polymeric soil release agents include those soil release agents having: (a) one or more nonionic hydrophile components consisting essentially of (i) polyoxyethylene segments with a degree of polymerization of at least 2, or (ii) oxypropylene or polyoxypropylene segments with a degree of polymerization of from 2 to 10, wherein said hydrophile segment does not encompass any oxypropylene unit unless it is bonded to adjacent moieties at each end by ether linkages, or (iii) a mixture of oxyalkylene units comprising oxyethylene and from 1 to about 30 oxypropylene units, said hydrophile segments preferably comprising at least about 25% oxyethylene units and more preferably, especially for such components having about 20 to 30 oxypropylene units, at least about 50% oxyethylene units; or (b) one or more hydrophobe components comprising (i) $C_3$ oxyalkylene terephthalate segments, wherein, if said hydrophobe components also comprise oxyethylene terephthalate, the ratio of oxyethylene terephthalate:$C_3$ oxyalkylene terephthalate units is about 2:1 or lower, (ii) $C_4$–$C_6$ alkylene or oxy $C_4$–$C_6$ alkylene segments, or mixtures therein, (iii) poly (vinyl ester) segments, preferably polyvinyl acetate, having a degree of polymerization of at least 2, or (iv) $C_1$–$C_4$ alkyl ether or $C_4$ hydroxyalkyl ether substituents, or mixtures therein, wherein said substituents are present in the form of $C_1$–$C_4$ alkyl ether or $C_4$ hydroxyalkyl ether cellulose derivatives, or mixtures therein, or a combination of (a) and (b).

Typically, the polyoxyethylene segments of (a)(i) will have a degree of polymerization of from about 200, although higher levels can be used, preferably from 3 to about 150, more preferably from 6 to about 100. Suitable oxy $C_4$–$C_6$ alkylene hydrophobe segments include, but are not limited to, end-caps of polymeric soil release agents such as $MO_3S(CH_2)_nOCH_2CH_2O$—, where M is sodium and n is an integer from 4–6, as disclosed in U.S. Pat. No. 4,721,580, issued Jan. 26, 1988 to Gosselink.

Polymeric soil release agents useful herein also include cellulosic derivatives such as hydroxyether cellulosic polymers, copolymeric blocks of ethylene terephthalate or propylene terephthalate with polyethylene oxide or polypropylene oxide terephthalate, and the like. Such agents are commercially available and include hydroxyethers of cellulose such as METHOCEL (Dow). Cellulosic soil release agents for use herein also include those selected from the group consisting of $C_1$–$C_4$ alkyl and $C_4$ hydroxyalkyl cellulose; see U.S. Pat. No. 4,000,093, issued Dec. 28, 1976 to Nicol, et al.

Soil release agents characterized by poly(vinyl ester) hydrophobe segments include graft copolymers of poly (vinyl ester), e.g., $C_1$–$C_6$ vinyl esters, preferably poly(vinyl acetate) grafted onto polyalkylene oxide backbones, such as polyethylene oxide backbones. See European Patent Application 0 219 048, published Apr. 22, 1987 by Kud, et al.

Another suitable soil release agent is a copolymer having random blocks of ethylene terephthalate and polyethylene oxide (PEO) terephthalate. The molecular weight of this polymeric soil release agent is in the range of from about 25,000 to about 55,000. See U.S. Pat. No. 3,959,230 to Hays, issued May 25, 1976 and U.S. Pat. No. 3,893,929 to Basadur issued Jul. 8, 1975.

Another suitable polymeric soil release agent is a polyester with repeat units of ethylene terephthalate units contains 10–15% by weight of ethylene terephthalate units together with 90–80% by weight of polyoxyethylene terephthalate units, derived from a polyoxyethylene glycol of average molecular weight 300–5,000.

Another suitable polymeric soil release agent is a sulfonated product of a substantially linear ester oligomer comprised of an oligomeric ester backbone of terephthaloyl and oxyalkyleneoxy repeat units and terminal moieties covalently attached to the backbone. These soil release agents are described fully in U.S. Pat. No. 4,968,451, issued Nov. 6, 1990 to J. J. Scheibel and E. P. Gosselink. Other suitable polymeric soil release agents include the terephthalate polyesters of U.S. Pat. No. 4,711,730, issued Dec. 8, 1987 to Gosselink et al, the anionic end-capped oligomeric esters of U.S. Pat. No. 4,721,580, issued Jan. 26, 1988 to Gosselink, and the block polyester oligomeric compounds of U.S. Pat. No. 4,702,857, issued Oct. 27, 1987 to Gosselink. Other polymeric soil release agents also include the soil release agents of U.S. Pat. No. 4,877,896, issued Oct. 31, 1989 to Maldonado et al, which discloses anionic, especially sulfoarolyl, end-capped terephthalate esters.

Another soil release agent is an oligomer with repeat units of terephthaloyl units, sulfoisoterephthaloyl units, oxyethyleneoxy and oxy-1,2-propylene units. The repeat units form the backbone of the oligomer and are preferably terminated with modified isethionate end-caps. A particularly preferred soil release agent of this type comprises about one sulfoisophthaloyl unit, 5 terephthaloyl units, oxyethyleneoxy and oxy-1,2-propyleneoxy units in a ratio of from about 1.7 to about 1.8, and two end-cap units of sodium 2-(2-hydroxyethoxy)-ethanesulfonate.

A preferred organic silver coating agent is a paraffin oil, typically a predominantly branched aliphatic hydrocarbon having a number of carbon atoms in the range of from 20 to 50; preferred paraffin oil selected from predominantly branched $C_{25-45}$ species with a ratio of cyclic to noncyclic hydrocarbons of from 1:10 to 2:1, preferably from 1:5 to 1:1. A paraffin oil meeting these characteristics, having a ratio of cyclic to noncyclic hydrocarbons of about 32:68, is sold by Wintershall, Salzbergen, Germany, under the trade name WINOG 70.

Nitrogen-containing Corrosion Inhibitor Compounds

Suitable nitrogen-containing corrosion inhibitor compounds include imidazole and derivatives thereof such as benzimidazole, 2-heptadecyl imidazole and those imidazole derivatives described in Czech Patent No. 139, 279 and British Patent GB-A-1,137,741, which also discloses a method for making imidazole compounds.

Also suitable as nitrogen-containing corrosion inhibitor compounds, are pyrazole compounds and their derivatives, particularly those where the pyrazole is substituted in any of the 1, 3, 4 or 5 positions by substituents $R_1$, $R_3$, $R_4$ and $R_5$ where $R_1$ is any of H, $CH_2OH$, $CONH_3$, or $COCH_3$, $R_3$ and $R_5$ are any of $C_1$–$C_{20}$ alkyl or hydroxyl, and $R_4$ is any of H, $NH_2$ or $NO_2$.

Other suitable nitrogen-containing corrosion inhibitor compounds include benzotriazole, 2-mercaptobenzothiazole, 1-phenyl-5-mercapto-1,2,3,4-tetrazole, thionalide, morpholine, melamine, distearylamine, stearoyl stearamide, cyanuric acid, aminotriazole, aminotetrazole and indazole.

Nitrogen-containing compounds such as amines, especially distearylamine and ammonium compounds such as ammonium chloride, ammonium bromide, ammonium sulphate or diammonium hydrogen citrate are also suitable.

Mn(II) Corrosion Inhibitor Compounds

The compositions may contain an Mn(II) corrosion inhibitor compound. The Mn(II) compound is preferably incorporated at a level of from 0.005% to 5% by weight, more preferably from 0.01% to 1%, most preferably from 0.02% to 0.4% by weight of the compositions. Preferably, the Mn(II) compound is incorporated at a level to provide from 0.1 ppm to 250 ppm, more preferably from 0.5 ppm to 50 ppm, most preferably from 1 ppm to 20 ppm by weight of Mn(II) ions in any bleaching solution.

The Mn (II) compound may be an inorganic salt in anhydrous, or any hydrated forms. Suitable salts include manganese sulphate, manganese carbonate, manganese phosphate, manganese nitrate, manganese acetate and manganese chloride. The Mn(II) compound may be a salt or complex of an organic fatty acid such as manganese acetate or manganese stearate.

The Mn(II) compound may be a salt or complex of an organic ligand. In one preferred aspect the organic ligand is a heavy metal ion sequestrant. In another preferred aspect the organic ligand is a crystal growth inhibitor.

Other Corrosion Inhibitor Compounds

Other suitable additional corrosion inhibitor compounds include, mercaptans and diols, especially mercaptans with 4 to 20 carbon atoms including lauryl mercaptan, thiophenol, thionapthol, thionalide and thioanthranol. Also suitable are saturated or unsaturated $C_{10}$–$C_{20}$ fatty acids, or their salts, especially aluminium tristearate. The $C_{12}$–$C_{20}$ hydroxy fatty acids, or their salts, are also suitable. Phosphonated octadecane decane and other anti-oxidants such as betahydroxytoluene (BHT) are also suitable.

Copolymers of butadiene and maleic acid, particularly those supplied under the trade reference no. 07787 by Polysciences Inc have been found to be of particular utility as corrosion inhibitor compounds.

Total Available Oxygen (AvO) Level

It has been found that, for optimal anti-silver tarnishing performance, the level of available oxygen in the present compositions, measured in units of % available oxygen by weight of the composition, is preferably controlled; the level of available oxygen should hence preferably be in the range from 0.3% to 2.5%, preferably from 0.5% to 1.7%, more preferably from 0.6% to 1.5%, most preferably from 0.7% to 1.2%, measured according to the method described hereunder.

Rate of Release of AvO

The rate of release of available oxygen is preferably also controlled; the rate of release of available oxygen from the compositions herein preferably should be such that, when using the method described hereinafter, the available oxygen is not completely released from the composition until after 3.5 minutes, preferably the available oxygen is released in a time interval of from 3.5 minutes to 10.0 minutes, more preferably from 4.0 minutes to 9.0 minutes, most preferably from 5.0 minutes to 8.5 minutes.

Method for Measuring Level of Total Available Oxygen (AvO) and Rate of Release of AvO in a Detergent Composition Method 1. A beaker of water (typically 2L) is placed on a stirrer Hotplate, and the stirrer speed is selected to ensure that the product is evenly dispersed through the solution.

2. The detergent composition (typically 8 g of product which has been sampled down from a bulk supply using a Pascal sampler), is added and simultaneously a stop clock is started.

3. The temperature control should be adjusted so as to maintain a constant temperature of 20° C. throughout the experiment.

4. Samples are taken from the detergent solution at 2 minute time intervals for 20 minutes, starting after 1 minute, and are titrated by the "titration procedure" described below to determine the level of available oxygen at each point.

Titration Procedure

1. An aliquot from the detergent solution (above) and 2 ml sulphuric acid are added into a stirred beaker 2. Approximately 0.2 g ammonium molybdate catalyst (tetra hydrate form) are added 3. 3 mls of 10% sodium iodide solution are added 4. Titration with sodium thiosulphate is conducted until the end point. The end point can be seen using either of two procedures. First procedure consists simply in seeing the yellow iodine colour fading to clear. The second and preferred procedure consists of adding soluble starch when the yellow colour is becoming faint, turning the solution blue. More thiosulphate is added until the end point is reached (blue starch complex is decolourised).

The level of AvO, measured in units of % available oxygen by weight, for the sample at each time interval corresponds to the amount of titre according to the following equation $$\frac{\text{Vol } S_2O_3(\text{ml}) \times \text{Molarity } (S_2O_3) \times 8}{\text{Sample Mass (g)}}$$

AvO level is plotted versus time to determine the maximum level of AvO, and the rate of release of AvO Controlled Rate of Release—Means A means may be provided for controlling the rate of release of oxygen bleach to the wash solution.

Means for controlling the rate of release of the bleach may provide for controlled release of peroxide species to the wash solution. Such means could, for example, include controlling the release of any inorganic perhydrate salt, acting as a hydrogen peroxide source, to the wash solution.

Suitable controlled release means can include coating any suitable component with a coating designed to provide the controlled release. The coating may therefore, for example, comprise a poorly water soluble material, or be a coating of sufficient thickness that the kinetics of dissolution of the thick coating provide the controlled rate of release.

The coating material may be applied using various methods. Any coating material is typically present at a weight ratio of coating material to bleach of from 1:99 to 1:2, preferably from 1:49 to 1:9.

Suitable coating materials include triglycerides (e.g. partially) hydrogenated vegetable oil, soy bean oil, cotton seed oil) mono or diglycerides, microcrystalline waxes, gelatin, cellulose, fatty acids and any mixtures thereof.

Other suitable coating materials can comprise the alkali and alkaline earth metal sulphates, silicates and carbonates, including calcium carbonate and silicas.

A preferred coating material, particularly for an inorganic perhydrate salt bleach source, comprises sodium silicate of $SiO_2$:$Na_2O$ ratio from 1.8:1 to 3.0:1, preferably 1.8:1 to 2.4:1, and/or sodium metasilicate, preferably applied at a level of from 2% to 10%, (normally from 3% to 5%) of $SiO_2$ by weight of the inorganic perhydrate salt. Magnesium silicate can also be included in the coating.

Any inorganic salt coating materials may be combined with organic binder materials to provide composite inorganic salt/organic binder coatings. Suitable binders include the $C_{10}$–$C_{20}$ alcohol ethoxylates containing from 5–100 moles of ethylene oxide per mole of alcohol and more preferably the $C_{15}$–$C_{20}$ primary alcohol ethoxylates containing from 20–100 moles of ethylene oxide per mole of alcohol.

Other preferred binders include certain polymeric materials. Polyvinylpyrrolidones with an average molecular weight of from 12,000 to 700,000 and polyethylene glycols (PEG) with an average molecular weight of from 600 to $5\times10^6$ preferably 1000 to 400,000 most preferably 1000 to 10,000 are examples of such polymeric materials. Copolymers of maleic anhydride with ethylene, methylvinyl ether or methacrylic acid, the maleic anhydride constituting at least 20 mole percent of the polymer are further examples of polymeric materials useful as binder agents. These polymeric materials may be used as such or in combination with solvents such as water, propylene glycol and the above mentioned $C_{10}$–$C_{20}$ alcohol ethoxylates containing from 5–100 moles of ethylene oxide per mole. Further examples of binders include the $C_{10}$–$C_{20}$ mono- and diglycerol ethers and also the $C_{10}$–$C_{20}$ fatty acids.

Cellulose derivatives such as methylcellulose, carboxymethylcellulose and hydroxyethylcellulose, and homo- or co-polymeric polycarboxylic acids or their salts are other examples of binders suitable for use herein.

One method for applying the coating material involves agglomeration. Preferred agglomeration processes include the use of any of the organic binder materials described hereinabove. Any conventional agglomerator/mixer may be used including, but not limited to pan, rotary drum and vertical blender types. Molten coating compositions may also be applied either by being poured onto, or spray atomized onto a moving bed of bleaching agent.

Other means of providing the required controlled release include mechanical means for altering the physical characteristics of the bleach to control its solubility and rate of release. Suitable protocols could include compaction, mechanical injection, manual injection, and adjustment of the solubility of the bleach compound by selection of particle size of any particulate component.

Whilst the choice of particle size will depend both on the composition of the particulate component, and the desire to meet the desired controlled release kinetics, it is desirable that the particle size should be more than 500 micrometers, preferably having an average particle diameter of from 800 to 1200 micrometers.

Additional protocols for providing the means of controlled release include the suitable choice of any other components of the detergent composition matrix such that when the composition is introduced to the wash solution the ionic strength environment therein provided enables the required controlled release kinetics to be achieved.

Alkalinity System

The compositions preferably contain an alkalinity system containing sodium silicate having an $SiO_2$:$Na_2O$ ratio of from 1.8 to 3.0, preferably from 1.8 to 2.4, most preferably 2.0, present preferably at a level of less than 20%, preferably from 1% to 15%, most preferably from 3% to 12% by weight of $SiO_2$. The alkali metal silicate may be in the form of either the anhydrous salt or a hydrated salt.

The alkalinity system also preferably contains sodium metasilicate, present at a level of at least 0.4% $SiO_2$ by weight. Sodium metasilicate has a nominal $SiO_2$:$Na_2O$ ratio of 1.0. The weight ratio of said sodium silicate to said sodium metasilicate, measured as $SiO_2$, is preferably from 50:1 to 5:4, more preferably from 15:1 to 2:1, most preferably from 10:1 to 5:2.

Heavy Metal Ion Sequestrant

The detergent compositions of the invention preferably contain as an optional component a heavy metal ion sequestrant. By heavy metal ion sequestrant it is meant herein components which act to sequester (chelate) heavy metal ions. These components may also have calcium and magnesium chelation capacity, but preferentially they show selectivity to binding heavy metal ions such as iron, manganese and copper.

Heavy metal ion sequestrants are generally present at a level of from 0.005% to 20%, preferably from 0.1% to 10%, more preferably from 0.25% to 7.5% and most preferably from 0.5% to 5% by weight of the compositions.

Heavy metal ion sequestrants, which are acidic in nature, having for example phosphonic acid or carboxylic acid functionalities, may be present either in their acid form or as a complex/salt with a suitable counter cation such as an alkali or alkaline metal ion, ammonium, or substituted ammonium ion, or any mixtures thereof. Preferably any salts/complexes are water soluble. The molar ratio of said counter cation to the heavy metal ion sequestrant is preferably at least 1:1.

Suitable heavy metal ion sequestrants for use herein include organic phosphonates, such as the amino alkylene poly (alkylene phosphonates), alkali metal ethane 1-hydroxy disphosphonates and nitrilo trimethylene phosphonates. Preferred among the above species are diethylene triamine penta (methylene phosphonate), ethylene diamine tri (methylene phosphonate) hexamethylene diamine tetra (methylene phosphonate) and hydroxy-ethylene 1,1 diphosphonate.

Other suitable heavy metal ion sequestrant for use herein include nitrilotriacetic acid and polyaminocarboxylic acids such as ethylenediaminotetracetic acid, ethylenetriamine pentacetic acid, ethylenediamine disuccinic acid, ethylenediamine diglutaric acid, 2-hydroxypropylenediamine disuccinic acid or any salts thereof.

Especially preferred is ethylenediamine-N,N'-disuccinic acid (EDDS) or the alkali metal, alkaline earth metal, ammonium, or substituted ammonium salts thereof, or mixtures thereof. Preferred EDDS compounds are the free acid form and the sodium or magnesium salt or complex thereof.

Crystal Growth Inhibitor Component

The detergent compositions preferably contain a crystal growth inhibitor component, preferably an organodiphosphonic acid component, incorporated preferably at a level of from 0.01% to 5%, more preferably from 0.1% to 2% by weight of the compositions.

By organo diphosphonic acid it is meant herein an organo diphosphonic acid which does not contain nitrogen as part of its chemical structure. This definition therefore excludes the organo aminophosphonates, which however may be included in compositions of the invention as heavy metal ion sequestrant components.

The organo diphosphonic acid is preferably a $C_1$–$C_4$ diphosphonic acid, more preferably a $C_2$ diphosphonic acid, such as ethylene diphosphonic acid, or most preferably ethane 1-hydroxy-1,1-diphosphonic acid (HEDP) and may be present in partially or fully ionized form, particularly as a salt or complex.

Enzyme

Another optional ingredient useful in the compositions is one or more enzymes. Preferred enzymatic materials include the commercially available lipases, amylases, neutral and alkaline proteases, esterases, cellulases, pectinases, lactases and peroxidases conventionally incorporated into detergent compositions. Suitable enzymes are discussed in U.S. Pat. Nos. 3,519,570 and 3,533,139.

Preferred commercially available protease enzymes include those sold under the tradenames Alcalase, Savinase, Primase, Durazym, and Esperase by Novo Industries A/S (Denmark), those sold under the tradename Maxatase, Maxacal and Maxapem by Gist-Brocades, those sold by Genencor International, and those sold under the tradename Opticlean and Optimase by Solvay Enzymes. Protease enzyme may be incorporated into the compositions in accordance with the invention at a level of from 0.0001% to 4% active enzyme by weight of the composition.

Preferred amylases include, for example, α-amylases obtained from a special strain of B licheniformis, described in more detail in GB-1,269,839 (Novo). Preferred commercially available amylases include for example, those sold under the tradename Rapidase by Gist-Brocades, and those sold under the tradename Termamyl and BAN by Novo Industries A/S. Amylase enzyme may be incorporated into the composition in accordance with the invention at a level of from 0.0001% to 2% active enzyme by weight of the composition.

Lipolytic enzyme (lipase) may be present at levels of active lipolytic enzyme of from 0.0001% to 2% by weight, preferably 0.001% to 1% by weight, most preferably from 0.001% to 0.5% by weight of the compositions. The lipase may be fungal or bacterial in origin. Lipase from chemically or genetically modified mutants of these strains are also useful herein. A preferred lipase is described in Granted European Patent, EP-B-0218272.

An especially preferred lipase herein is obtained by cloning the gene from *Humicola lanuginosa* and expressing the gene in *Aspergillus oryza,* as host, as described in European Patent Application, EP-A-0258 068, which is commercially available from Novo Industries A/S, Bagsvaerd, Denmark, under the trade name Lipolase. This lipase is also described in U.S. Pat. No. 4,810,414, Huge-Jensen et al, issued Mar. 7, 1989.

Enzyme Stabilizing System

Preferred enzyme-containing compositions herein may comprise from about 0.001% to about 10%, preferably from about 0.005% to about 8%, most preferably from about 0.01% to about 6%, by weight of an enzyme stabilizing system. The enzyme stabilizing system can be any stabilizing system which is compatible with the detersive enzyme. Such stabilizing systems can comprise calcium ion, boric acid, propylene glycol, short chain carboxylic acid, boronic acid, chlorine bleach scavengers and mixtures thereof. Such stabilizing systems can also comprise reversible enzyme inhibitors, such as reversible protease inhibitors.

Organic Polymeric Compound

Organic polymeric compounds may be added as preferred components of the compositions in accord with the invention. By organic polymeric compound it is meant essentially any polymeric organic compound commonly used as dispersants, and anti-redeposition and soil suspension agents in detergent compositions. Organic polymer compounds, however, have not been previously described as soil release agents in dishwashing.

Organic polymeric compound is typically incorporated in the detergent compositions of the invention at a level of from 0.1% to 30%, preferably from 0.5% to 15%, most preferably from 1% to 10% by weight of the compositions.

Examples of organic polymeric compounds include the water soluble organic homo- or co-polymeric polycarboxylic acids or their salts in which the polycarboxylic acid comprises at least two carboxyl radicals separated from each other by not more than two carbon atoms. Polymers of the latter type are disclosed in GB-A-1,596,756. Examples of such salts are polyacrylates of molecular weight 2000–10000 and their copolymers with any suitable other monomer units including modified acrylic, fumaric, maleic, itaconic, aconitic, mesaconic, citraconic and methylenemalonic acid or their salts, maleic anhydride, acrylamide, alkylene, vinylmethyl ether, styrene and any mixtures thereof. Preferred are the copolymers of acrylic acid and maleic anhydride having a molecular weight of from 20,000 to 100,000.

Preferred commercially available acrylic acid containing polymers having a molecular weight below 15,000 include those sold under the tradename Sokalan PA30, PA20, PA15, PA10 and Sokalan CP10 by BASF GmbH, and those sold under the tradename Acusol 45N by Rohm and Haas.

Preferred acrylic acid containing copolymers include those which contain as monomer units: a) from 90% to 10%, preferably from 80% to 20% by weight acrylic acid or its salts and b) from 10% to 90%, preferably from 20% to 80% by weight of a substituted acrylic monomer or its salts having the general formula —[$CR_2$—$CR_1$(CO—O—$R_3$)]— wherein at least one of the substituents $R_1$, $R_2$ or $R_3$, preferably $R_1$ or $R_2$ is a 1 to 4 carbon alkyl or hydroxyalkyl group, $R_1$ or $R_2$ can be a hydrogen and $R_3$ can be a hydrogen or alkali metal salt. Most preferred is a substituted acrylic monomer wherein $R_1$ is methyl, $R_2$ is hydrogen (i.e. a methacrylic acid monomer). The most preferred copolymer of this type has a molecular weight of 3500 and contains 60% to 80% by weight of acrylic acid and 40% to 20% by weight of methacrylic acid.

The polyamino compounds are useful herein including those derived from aspartic acid such as those disclosed in EP-A-305282, EP-A-305283 and EP-A-351629.

Clay Softening System

The detergent compositions may contain a clay softening system comprising a clay mineral compound and optionally a clay flocculating agent.

The clay mineral compound is preferably a smectite clay compound. Smectite clays are disclosed in the U.S. Pat. Nos. 3,862,058, 3,948,790, 3,954,632 and 4,062,647. European Patents Nos. EP-A-299,575 and EP-A-313,146 in the name of the Procter and Gamble Company describe suitable organic polymeric clay flocculating agents.

Lime Soap Dispersant Compound

The compositions of the invention may contain a lime soap dispersant compound, preferably present at a level of from 0.1% to 40% by weight, more preferably 1% to 20% by weight, most preferably from 2% to 10% by weight of the compositions.

A lime soap dispersant is a material that prevents the precipitation of alkali metal, ammonium or amine salts of fatty acids by calcium or magnesium ions. Preferred lime soap dispersant compounds are disclosed in PCT Application No. W093/08877.

Suds Suppressing System

The compositions of the invention, when formulated for use in machine washing compositions, preferably comprise a suds suppressing system present at a level of from 0.01% to 15%, preferably from 0.05% to 10%, most preferably from 0.1% to 5% by weight of the composition.

Suitable suds suppressing systems for use herein may comprise essentially any known antifoam compound, including, for example silicone antifoam compounds, 2-alkyl and alcanol antifoam compounds. Preferred suds suppressing systems and antifoam compounds are disclosed in PCT Application No. W093/08876 and copending European Application No. 93870132.3.

Polymeric Dye Transfer Inhibiting Agents

The compositions herein may also comprise from 0.01% to 10%, preferably from 0.05% to 0.5% by weight of polymeric dye transfer inhibiting agents.

The polymeric dye transfer inhibiting agents are preferably selected from polyamine N-oxide polymers, copolymers of N-vinylpyrrolidone and N-vinylimidazole, polyvinylpyrrolidonepolymers or combinations thereof.

Optical Brightener

The detergent compositions herein also optionally contain from about 0.005% to 5% by weight of certain types of hydrophilic optical brighteners.

Hydrophilic optical brighteners useful herein include those having the structural formula:

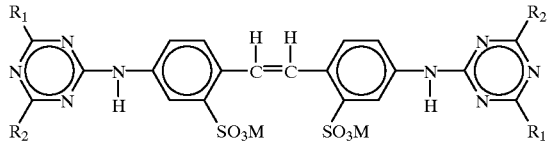

wherein $R_1$ is selected from anilino, N-2-bis-hydroxyethyl and NH-2-hydroxyethyl; R2 is selected from N-2-bis-hydroxyethyl, N-2-hydroxyethyl-N-methylamino, morphilino, chloro and amino; and M is a salt-forming cation such as sodium or potassium.

When in the above formula, $R_1$ is anilino, $R_2$ is N-2-bis-hydroxyethyl and M is a cation such as sodium, the brightener is 4,4',-bis[(4-anilino-6-(N-2-bis-hydroxyethyl)-s-triazine-2-yl)amino]-2,2'-stilbenedisulfonic acid and disodium salt. This particular brightener species is commercially marketed under the tradename Tinopal-UNPA-GX by Ciba-Geigy Corporation.

Tinopal-UNPA-GX is the preferred hydrophilic optical brightener useful in the detergent compositions herein.

When in the above formula, $R_1$ is anilino, R2 is N-2-hydroxyethyl-N-2-methylamino and M is a cation such as sodium, the brightener is 4,4'-bis [(4-anilino-6-(N-2-hydroxyethyl-N-methylamino)-s-triazine-2-yl)amino]2,2'-stilbenedisulfonic acid disodium salt. This particular brightener species is commercially marketed under the tradename Tinopal 5BM-GX by Ciba-Geigy Corporation.

When in the above formula, $R_1$ is anilino, $R_2$ is morphilino and M is a cation such as sodium, the brightener is 4,4'-bis[(4-anilino-6-morphilino-s-triazine-2-yl)amino]2,2'-stilbenedisulfonic acid, sodium salt. This particular brightener species is commercially marketed under the tradename Tinopal AMS-GX by Ciba Geigy Corporation.

Cationic Fabric Softening Agents

Cationic fabric softening agents can also be incorporated into compositions in accordance with the present invention. Suitable cationic fabric softening agents include the water insoluble tertiary amines or dilong chain amide materials as disclosed in GB-A-1 514 276 and EP-B-0 011 340.

Cationic fabric softening agents are typically incorporated at total levels of from 0.5% to 15% by weight, normally from 1% to 5% by weight.

Other Optional Ingredients

Other optional ingredients suitable for inclusion in the compositions of the invention include perfumes, colours and filler salts, with sodium sulfate being a preferred filler salt.

pH of the Compositions

The detergent compositions used in the present invention are preferably not formulated to have an unduly high pH, in preference having a pH measured as a 1% solution in distilled water of from 8.0 to 12.5, more preferably from 9.0 to 11.8, most preferably from 9.5 to 11.5.

Form of the Compositions

The detergent compositions used in this invention can be formulated in any desirable form such as powders, granulates, pastes, liquids, gels and tablets, granular and tablet forms being preferred.

The bulk density of the granular detergent compositions in accordance with the present invention is typically of at least 650 g/liter, more usually at least 700 g/litre and more preferably from 800 g/liter to 1200 g/liter.

The particle size of the components of granular compositions in accordance with the invention should preferably be such that no more that 5% of particles are greater than 1.4 mm in diameter and not more than 5% of particles are less than 0.15 mm in diameter.

Compacted solids may be manufactured using any suitable compacting process, such as tabletting, briquetting or extrusion, preferably tabletting. Preferably tablets are manufactured using a standard rotary tabletting press using compression forces of from 5 to 13 $KN/cm^2$, more preferably from 5 to 11 $KN/cm^2$ so that the compacted solid has a minimum hardness of 176N to 275N, preferably from 195N to 245N, measured by a C100 hardness test as supplied by I. Holland instruments. This process may be used to prepare homogeneous or layered tablets of any size or shape. Preferably tablets are symmetrical to ensure the uniform dissolution of the tablet in the wash solution.

According to the present invention the compacted solid form detergent composition may find utility in all types of automatic dish- and laundry washing machines including industrial and domestic machines.

Generally, if the compositions are in liquid form the liquid should be thixotropic (ie; exhibit high viscosity when subjected to low stress and lower viscosity when subjected to high stress), or at least have very high viscosity, for example, of from 1,000 to 10,000,000 centipoise.

Machine Dishwashing Method

Any suitable methods for machine washing or cleaning soiled tableware, particularly soiled silverware are envisaged.

A preferred machine dishwashing method comprises treating soiled articles selected from crockery, glassware, hollowware, silverware and cutlery and mixtures thereof, with an aqueous liquid having dissolved or dispensed therein an effective amount of a machine dishwashing composition in accord with the invention. By an effective amount of the machine dishwashing composition it is meant from 8 g to 60 g of product dissolved or dispersed in a wash solution of volume from 3 to 10 liters, as are typical product dosages and wash solution volumes commonly employed in conventional machine dishwashing methods.

Laundry Washing Method

Machine laundry methods herein typically comprise treating soiled laundry with an aqueous wash solution in a washing machine having dissolved or dispensed therein an effective amount of a machine laundry detergent composition in accord with the invention. By an effective amount of the detergent composition it is meant from 40 g to 300 g of product dissolved or dispersed in a wash solution of volume from 5 to 65 liters, as are typical product dosages and wash solution volumes commonly employed in conventional machine laundry methods.

In a preferred use aspect a dispensing device is employed in the washing method. The dispensing device is charged with the detergent product, and is used to introduce the product directly into the drum of the washing machine before the commencement of the wash cycle. Its volume capacity should be such as to be able to contain sufficient detergent product as would normally be used in the washing method.

Once the washing machine has been loaded with laundry the dispensing device containing the detergent product is placed inside the drum. At the commencement of the wash cycle of the washing machine water is introduced into the drum and the drum periodically rotates. The design of the dispensing device should be such that it permits containment of the dry detergent product but then allows release of this product during the wash cycle in response to its agitation as the drum rotates and also as a result of its contact with the wash water.

To allow for release of the detergent product during the wash the device may possess a number of openings through which the product may pass. Alternatively, the device may be made of a material which is permeable to liquid but impermeable to the solid product, which will allow release of dissolved product. Preferably, the detergent product will be rapidly released at the start of the wash cycle thereby providing transient localised high concentrations of product in the drum of the washing machine at this stage of the wash cycle.

Preferred dispensing devices are reusable and are designed in such a way that container integrity is maintained in both the dry state and during the wash cycle. Especially preferred dispensing devices for use with the composition of the invention have been described in the following patents;

GB-B-2, 157, 717, GB-B-2, 157, 718, EP-A-0201376, EP-A-0288345 and EP-A-0288346. An article by J. Bland published in Manufacturing Chemist, November 1989, pages 41–46 also describes especially preferred dispensing devices for use with granular laundry products which are of a type commonly know as the "granulette". Another preferred dispensing device for use with the compositions of this invention is disclosed in PCT Patent Application No. WO94/11562.

Especially preferred dispensing devices are disclosed in European Patent Application Publication Nos. 0343069 & 0343070. The latter Application discloses a device comprising a flexible sheath in the form of a bag extending from a support ring defining an orifice, the orifice being adapted to admit to the bag sufficient product for one washing cycle in a washing process. A portion of the washing medium flows through the orifice into the bag, dissolves the product, and the solution then passes outwardly through the orifice into the washing medium. The support ring is provided with a masking arrangement to prevent egress of wetted, undissolved, product, this arrangement typically comprising radially extending walls extending from a central boss in a spoked wheel configuration, or a similar structure in which the walls have a helical form.

Alternatively, the dispensing device may be a flexible container, such as a bag or pouch. The bag may be of fibrous construction coated with a water impermeable protective material so as to retain the contents, such as is disclosed in European published Patent Application No. 0018678. Alternatively it may be formed of a water-insoluble synthetic polymeric material provided with an edge seal or closure designed to rupture in aqueous media as disclosed in European published Patent Application Nos. 0011500, 0011501, 0011502, and 0011968. A convenient form of water frangible closure comprises a water soluble adhesive disposed along and sealing one edge of a pouch formed of a water impermeable polymeric film such as polyethylene or polypropylene.

EXAMPLES

Abbreviations Used in Examples

In the detergent compositions, the abbreviated component identifications have the following meanings:

| | |
|---|---|
| LAS | Sodium linear $C_{12}$ alkyl benzene sulfonate |
| TAS | Sodium tallow alkyl sulfate |
| C45AS | Sodium $C_{14}$—$C_{15}$ linear alkyl sulfate |
| CxyEzS | Sodium $C_{1x}$—$C_{1y}$ branched alkyl sulfate condensed with z moles of ethylene oxide |
| C45E7 | A $C_{14-15}$ predominantly linear primary alcohol condensed with an average of 7 moles of ethylene oxide |
| C25E3 | A $C_{14-15}$ branched primary alcohol condensed with an average of 3 moles of ethylene oxide |
| C25E5 | A $C_{12-15}$ branched primary alcohol condensed with an average of 5 moles of ethylene oxide |
| CEQ | $R_1COOCH_2CH_2.N^+(CH_3)_3$ With $R_1 = C_{11}$—$C_{13}$ |
| QAS | $R_2.N^+(CH_3)_2(C_2H_4OH$ with $R_2 = C_{12}$—$C_{14}$ |
| Soap | Sodium linear alkyl carboxylate derived from an 80/20 mixture of tallow and coconut oils |
| TFAA | $C_{16}$—$C_{18}$ alkyl N-methyl glucamide |
| TPKFA | $C_{12}$—$C_{14}$ topped whole cut fatty acids |
| Zeolite A | Hydrated Sodium Aluminosilicate of formula $Na_{12}(A10_2SiO_2)_{12}.27H_2O$ having a primary particle size in the range from 0.1 to 10 micrometers |
| Zeolite MAP | Hydrated sodium aluminosilicate MAP having a silicon to aluminium ratio of 1.07:1. |
| NaSKS-6 | Crystalline layered silicate of formula $\delta$-$Na_2Si_2O_5$ |
| Citric Acid | Anhydrous citric acid |
| Bicarbonate | Anhydrous sodium bicarbonate with a particle size distribution between 400 $\mu$m and 1200 $\mu$m |
| MA/AA | Copolymer of 1:4 maleic/acrylic acid, average molecular weight about 70,000 |
| CMC | Sodium carboxymethyl cellulose |
| Alcalase | Proteolytic enzyme of activity 3AU/g sold by NOVO Industries A/S |
| Cellulase | Cellulytic enzyme of activity 1000 CEVU/g sold by NOVO Industries A/S under the tradename Carezyme |
| Lipase | Lipolytic enzyme of activity 100 kLU/g sold by NOVO Industries A/S under the tradename Lipolase |
| Endolase | Endoglucase enzyme of activity 3000 CEVU/g sold by NOVO Industries A/S |
| Photoactivated bleach | Sulfonated Zinc Phythlocyanine encapsulated in dextrin soluble polymer |
| Brightener 1 | Disodium 4,4'-bis(2-sulphostyryl)biphenyl |
| Brightener 2 | Disodium 4,4'-bis(4-anilino-6-morpholino-1.3.5-triazin-2-yl)amino) stilbene-2:2'-disulfonate |
| PVNO | Polyvinylpyridine N-oxide |
| PVPVI | Copolymer of polyvinylpyrolidone and vinylimidazole |
| SRP 1 | Sulfobenzoyl end capped esters with oxyethylene oxy and terephtaloyl backbone |
| SRP 2 | Diethoxylated poly (1,2 propylene terephtlate) short block polymer |
| Silicone antifoam | Polydimethylsiloxane foam controller with siloxane-oxyalkylene copolymer as dispersing agent with a ratio of said form controller to said dispersing agent of 10:1 to 100:1 |
| NOBS | Nonanoyloxybenzene sulfonate in the form of the sodium salt |
| STPP | Sodium tripolyphosphate |
| MGDA | Methyl Glycine Diacetic acid |
| Citrate | Tri-sodium citrate dihydrate |
| Carbonate | Anhydrous sodium carbonate |
| Silicate | Amorphous Sodium Silicate ($SiO_2$:$Na_2O$ ratio = 2.0) |
| Metasilicate | Sodium metasilicate ($SiO_2$:$Na_2O$ ratio = 1.0) |
| PB1 | Anhydrous sodium perborate monohydrate |
| PB4 | Sodium perborate tetrahydrate of nominal formula $NaBO_2.3H_2O.H_2O_2$ |
| Percarbonate | Anhydrous sodium percarbonate of nominal formula $2.Na_2CO_3.3H_2O_2$ |

-continued

| | |
|---|---|
| Mn Catalyst | $Mn^{IV}{}_2(m\text{-}O)_3(1,4,7\text{-trimethyl-}1,4,7\text{-triazacyclononane})_2\text{-}(PF_6)_2$as described in U.S. Pat. Nos. 5 246 621 and 5 244 594. |
| Nonionic | $C_{13}$—$C_{15}$ mixed ethoxylated/propoxylated fatty alcohol with an average degree of ethoxylation of 3.8 and an average degree of propoxylation of 4.5 sold under the tradename Plurafac LF404 by BASF GmbH (low foaming) |
| TAED | Tetraacetyl ethylene diamine |
| HEDP | Ethane 1-hydroxy-1,1-diphosphonic acid |
| DETPMP | Diethyltriamine penta (methylene) phosphonate, marketed by monsanto under the tradename Dequest 2060 |
| PAAC | Pentaamine acetate cobalt (III) salt |
| BzP | Benzoyl Peroxide |
| Paraffin | Paraffin oil sold under the tradename Winog 70 by Wintershall. |
| Protease | Proteolytic enzyme of activity 4KNPU/g sold under the tradename Savinase by Novo Industries A/S |
| Amylase | Amylolytic enzyme of activity 60KNU/g sold under tradename Termamyl 60T by Novo Industries A/S |
| BTA | Benzotriazole |
| Bismuth nitrate | Bismuth nitrate salt |
| PA30 | Polyacrylic acid of average molecular weight approximately 8,000 |
| Terpolymer | Terpolymer of average molecular weight approx. 7,000, comprising acrylic:maleic:ethylacrylic acid monomer units at a weight ratio of 60:20:20 |
| 480N | Random copolymer of 3:7 acrylic/methacrylic acid, average molecular weight about 3,500 |
| Sulphate | Anhydrous sodium sulphate. |
| NaDCC | Sodium dichloroisocyanurate |
| KOH | 100% active solution of Potassium Hydroxide |
| BSA | Amylotic enzyme sold under the tradename LE17 by Novo Industries A/S (approx 1% enzyme activity) |
| pH | Measured as a 1% solution in distilled water at 20° C. |

In the following examples all levels are quoted as % by weight of the composition:

Example 1

The following compact high density (0.96 Kg/l) dish-washing detergent compositions A to F were prepared:

| | A | B | C | D | E | F |
|---|---|---|---|---|---|---|
| STPP | 24.80 | 24.80 | 25.00 | 28.39 | 28.50 | 20.00 |
| Citrate | — | — | — | — | 10.00 | 10.00 |
| Carbonate | — | — | 17.50 | 17.50 | — | — |
| MGDA | — | 2.50 | 2.00 | 2.00 | 3.00 | 2.00 |
| Silicate | 20.36 | 20.36 | 14.81 | 14.81 | 14.81 | — |
| Metasilicate | 2.50 | 2.50 | 2.50 | — | — | — |
| PB1 | — | — | 2.00 | — | 3.00 | — |
| Percarbonate | 7.00 | 4.00 | 5.78 | 10.00 | 7.65 | 6.70 |
| Non-ionic | 1.50 | 1.50 | 2.00 | 1.50 | 2.00 | 2.60 |
| TAED | 2.39 | 2.39 | 2.39 | — | — | 4.00 |
| HEDP | 0.46 | 0.46 | 1.00 | — | 0.83 | — |
| DETPMP | — | — | 0.65 | — | — | — |
| PAAC | — | — | — | 0.20 | — | — |
| BzP | — | — | — | 4.44 | — | — |
| Paraffin | 0.50 | 0.50 | 0.50 | 0.50 | — | 0.20 |
| Protease | 2.20 | 2.20 | 2.20 | 2.20 | 2.00 | 0.50 |
| Amylase | 1.50 | 1.50 | 1.20 | 1.50 | 1.00 | 1.10 |
| BTA | 0.30 | 0.30 | 0.30 | 0.30 | — | — |
| Bismuth Nitrate | — | — | 0.30 | — | — | — |
| PA30 | — | — | — | — | — | — |
| Terpolymer | — | — | — | 4.00 | — | — |
| 480N | 2.77 | 2.77 | 6.00 | — | 6.67 | — |

-continued

| | A | B | C | D | E | F |
|---|---|---|---|---|---|---|
| Sulphate | 8.44 | 8.44 | 20.77 | — | 23.24 | 1.00 |
| Misc inc moisture to balance | | | | | | |
| pH (1% solution) | 10.90 | 10.90 | 11.00 | 10.80 | 10.90 | 9.60 |

Example 2

The following granular dishwashing detergent compositions examples G to L of bulk density 1.02 Kg/L were prepared in accord with the invention:

| | G | H | I | J | K | L |
|---|---|---|---|---|---|---|
| STPP | 30.00 | 30.00 | 30.00 | 27.90 | 34.50 | 26.70 |
| Carbonate | 30.50 | 23.50 | 30.50 | 23.00 | 30.50 | 2.80 |
| MGDA | — | 2.00 | 2.00 | 5.00 | 5.00 | 2.00 |
| Silicate | 7.40 | 7.40 | 7.40 | 12.00 | 8.00 | 18.34 |
| PB1 | — | — | — | — | 4.40 | — |
| Percarbonate | 6.00 | 6.00 | 6.00 | 2.00 | 2.00 | 1.50 |
| Nonionic | 0.75 | 0.75 | 0.75 | 1.90 | 1.20 | 0.50 |
| TAED | 1.00 | 1.00 | — | — | 1.00 | — |
| PAAC | — | — | 0.004 | — | — | — |
| BzP | — | 1.40 | — | — | — | — |
| Paraffin | 0.25 | 0.25 | 0.25 | — | — | — |
| Protease | 1.10 | 1.10 | 1.10 | — | 2.20 | — |
| Amylase | 0.38 | 0.38 | 0.38 | — | 0.80 | — |
| BTA | 0.15 | — | 0.15 | — | — | — |
| Sulphate | 23.90 | 21.90 | 21.90 | 26.40 | 12.40 | — |
| Misc inc moisture to balance | | | | | | |
| pH (1% solution) | 10.80 | 10.80 | 10.80 | 10.70 | 10.70 | 12.30 |

Example 3

The following detergent composition tablets in accord with the present invention of 25 g weight were prepared by compression of a granular dishwashing detergent composition at a pressure of 13 KN/cm$^2$ using a standard 12 head rotary press:

| | M | N | O |
|---|---|---|---|
| STPP | 45.00 | 38.80 | 32.50 |
| Citrate | — | — | 15.00 |
| Carbonate | — | 5.00 | — |
| MGDA | — | 4.00 | 2.00 |
| Silicate | 26.40 | 14.80 | 25.00 |
| Protease | 1.76 | 2.20 | 0.60 |
| Amylase | 1.20 | — | 0.60 |
| PB1 | 1.56 | — | — |
| Percarbonate | 6.92 | 9.98 | 13.40 |
| Nonionic | 1.20 | 2.00 | 1.10 |
| TAED | 4.33 | 2.39 | 0.80 |
| HEDP | 0.67 | 0.67 | — |
| DETPMP | 0.65 | — | — |
| Paraffin | 0.42 | 0.50 | — |
| BTA | 0.24 | 0.30 | — |
| PA30 | 3.2 | — | — |
| Sulphate | 25.05 | 12.70 | 1.20 |
| Misc inc moisture to balance | | | |
| pH (1% solution) | 10.60 | 10.60 | 11.00 |

Example 4

The following liquid detergent compositions in accord with the present invention P to Q, of density 1.40 Kg/L were prepared:

| | P | Q |
|---|---|---|
| STPP | 31.30 | 18.00 |
| Carbonate | 2.70 | 2.00 |
| MGDA | 2.00 | 2.00 |
| Silicate | — | 4.40 |
| Percarbonate | 5.00 | 6.40 |
| Nonionic | 2.50 | 1.00 |
| Paraffin | 2.20 | — |
| Protease | 0.60 | 0.50 |
| Amylase | 0.80 | 0.40 |
| 480N | 0.50 | 4.00 |
| KOH | — | 6.00 |
| Sulphate | 1.60 | — |
| Misc inc moisture to balance | | |
| pH (1% solution) | 9.10 | 10.00 |

Example 5

The following granular laundry detergent compositions A' to C' of bulk density 750 g/liter were prepared in accord with the invention:

| | A' | B' | C' |
|---|---|---|---|
| LAS | 5.25 | 5.61 | 4.76 |
| TAS | 1.25 | 1.86 | 1.57 |
| C45AS | — | 2.24 | 3.89 |
| C25AE3S | — | 0.76 | 1.18 |
| C45E7 | 3.25 | — | 5.0 |
| C25E3 | — | 5.5 | — |
| CEQ | 0.8 | 2.0 | 2.0 |
| STPP | 19.7 | 19.5 | 19.5 |
| MGDA | 0.2 | 0.3 | 10.0 |
| Zeolite A | — | — | 19.5 |
| Zeolite MAP | — | 19.5 | — |
| NaSKS-6/citric acid (79:21) | — | 10.6 | 10.6 |
| Carbonate | 6.1 | 21.4 | 21.4 |
| Bicarbonate | — | 2.0 | 2.0 |
| Silicate | 6.8 | — | — |
| Sodium sulfate | 39.8 | — | 14.3 |
| Percarbonate | 7.0 | 14.7 | 14.0 |
| Mn Catalyst | 0.3 | — | 0.1 |
| TAED | 0.5 | 3.1 | — |
| DETPMP | 0.25 | 0.2 | 0.2 |
| HEDP | — | 0.3 | 0.3 |
| Protease | 0.26 | 0.85 | 0.85 |
| Lipase | 0.15 | 0.15 | 0.15 |
| Cellulase | 0.28 | 0.28 | 0.28 |
| Amylase | 0.1 | 0.1 | 0.1 |
| MA/AA | 0.8 | 1.6 | 1.6 |
| CMC | 0.2 | 0.4 | 0.4 |
| Photoactivated bleach (ppm) | 15 ppm | 27 ppm | 27 ppm |
| Brightener 1 | 0.08 | 0.19 | 0.19 |
| Brightener 2 | — | 0.04 | 0.04 |
| Perfume | 0.3 | 0.3 | 0.3 |
| Silicone antifoam | 0.5 | 2.4 | 2.4 |
| Minors/misc to 100% | | | |

Example 6

The following detergent formulations, according to the present invention were prepared:

| | D' | E' | F' |
|---|---|---|---|
| Blown Powder | | | |
| STPP | 24.0 | — | 24.0 |
| Zeolite A | — | 24.0 | — |
| MGDA | 0.1 | 0.5 | 2.0 |
| C45AS | 9.0 | 6.0 | 13.0 |
| MA/AA | 2.0 | 4.0 | 2.0 |
| LAS | 6.0 | 8.0 | 11.0 |
| TAS | 2.0 | — | — |
| Silicate | 7.0 | 3.0 | 3.0 |
| CMC | 1.0 | 1.0 | 0.5 |
| Brightener 2 | 0.2 | 0.2 | 0.2 |
| Soap | 1.0 | 1.0 | 1.0 |
| DTPMP | 0.4 | 0.4 | 0.2 |
| Spray On | | | |
| C45E7 | 2.5 | 2.5 | 2.0 |
| C25E3 | 2.5 | 2.5 | 2.0 |
| Silicone antifoam | 0.3 | 0.3 | 0.3 |
| Perfume | 0.3 | 0.3 | 0.3 |
| Dry additives | | | |
| Carbonate | 6.0 | 13.0 | 15.0 |
| PB4 | 3.0 | 4.0 | — |
| Percarbonate | 6.0 | 6.0 | 7.0 |
| Mn Catalyst | — | 0.3 | — |
| TAED | 3.0 | 3.0 | 1.0 |
| Photoactivated bleach | 0.02 | 0.02 | 0.02 |
| Protease | 1.0 | 1.0 | 1.0 |
| Lipase | 0.4 | 0.4 | 0.4 |
| Amylase | 0.25 | 0.30 | 0.15 |
| Dry mixed sodium sulfate | 3.0 | 3.0 | 5.0 |
| Balance (Moisture & Miscellaneous) | 100.0 | 100.0 | 100.0 |
| Density (g/liter) | 630 | 670 | 670 |

Example 7

The following nil bleach-containing detergent formulations of particular use in the washing of colored clothing, according to the present invention were prepared:

| | G' | H' |
|---|---|---|
| Blown Powder | | |
| STPP | 15.0 | 15.0 |
| MGDA | 0.2 | 2.0 |
| Sodium sulfate | 0.0 | 5.0 |
| LAS | 3.0 | 3.0 |
| DTPMP | 0.4 | 0.5 |
| CMC | 0.4 | 0.4 |
| MA/AA | 4.0 | 4.0 |
| Agglomerates | | |
| C45AS | — | — |
| LAS | 6.0 | 5.0 |
| TAS | 3.0 | 2.0 |
| Silicate | 4.0 | 4.0 |
| Zeolite A | 10.0 | 15.0 |
| CMC | — | — |
| MA/AA | — | — |
| Carbonate | 9.0 | 7.0 |

-continued

| | G' | H' |
|---|---|---|
| Spray On | | |
| Perfume | 0.3 | 0.3 |
| C45E7 | 4.0 | 4.0 |
| C25E3 | 2.0 | 2.0 |
| Dry additives | | |
| MA/AA | — | — |
| NaSKS-6 | — | — |
| Citrate | 10.0 | — |
| Bicarbonate | 7.0 | 3.0 |
| Carbonate | 8.0 | 5.0 |
| Percarbonate | 10.00 | 14.00 |
| Mn Catalyst | 0.1 | 0.1 |
| PVPVI/PVNO | 0.5 | 0.5 |
| Alcalase | 0.5 | 0.3 |
| Lipase | 0.4 | 0.4 |
| Amylase | 0.6 | 0.6 |
| Cellulase | 0.6 | 0.6 |
| Silicone antifoam | 5.0 | 5.0 |
| Dry additives | | |
| Sodium sulfate | 0.0 | 9.0 |
| Balance (Moisture and Miscellaneous) | 100.0 | 100.0 |
| Density (g/liter) | 700 | 700 |

Example 8

The following detergent formulations, according to the present invention were prepared:

| | I' | J' | K' | L' |
|---|---|---|---|---|
| LAS | 20.0 | 14.0 | 24.0 | 22.0 |
| QAS | 0.7 | 1.0 | — | 0.7 |
| TFAA | — | 1.0 | — | — |
| C25E5/C45E7 | — | 2.0 | — | 0.5 |
| C45E3S | — | 2.5 | — | — |
| STPP | 30.0 | 18.0 | 30.0 | 22.0 |
| Silicate | 9.0 | 5.0 | 10.0 | 8.0 |
| Carbonate | 13.0 | 7.5 | — | 5.0 |
| MGDA | 2.0 | 2.0 | 2.0 | 2.0 |
| Bicarbonate | — | 7.5 | — | — |
| DTPMP | 0.7 | 1.0 | — | — |
| SRP 1 | 0.3 | 0.2 | — | 0.1 |
| MA/AA | 2.0 | 1.5 | 2.0 | 1.0 |
| CMC | 0.8 | 0.4 | 0.4 | 0.2 |
| Protease | 0.8 | 1.0 | 0.5 | 0.5 |
| Amylase | 0.8 | 0.4 | — | 0.25 |
| Lipase | 0.2 | 0.1 | 0.2 | 0.1 |
| Cellulase | 0.15 | 0.05 | — | — |
| Photoactivated bleach (ppm) | 70 ppm | 45 ppm | — | 10 ppm |
| Brightener 1 | 0.2 | 0.2 | 0.08 | 0.2 |
| Percarbonate | 8.0 | 4.0 | 7.65 | 4.76 |
| NOBS | 2.0 | 1.0 | — | — |
| Balance (Moisture and Miscellaneous) | 100 | 100 | 100 | 100 |

Example 9

The following detergent formulations, according to the present invention were prepared:

| | M' | N' | O' |
|---|---|---|---|
| Blown Powder | | | |
| STPP | 30.0 | 22.0 | 6.0 |
| MGDA | 2.0 | 2.0 | 2.0 |
| Sodium sulfate | 19.0 | 5.0 | 7.0 |
| MA/AA | 3.0 | 3.0 | 6.0 |
| LAS | 14.0 | 12.0 | 22.0 |
| C45AS | 8.0 | 7.0 | 7.0 |
| Silicate | — | 1.0 | 5.0 |
| Soap | — | — | 2.0 |
| Brightener 1 | 0.2 | 0.2 | 0.2 |
| Carbonate | 8.0 | 16.0 | 20.0 |
| DTPMP | — | 0.4 | 0.4 |
| Spray On | | | |
| C45E7 | 1.0 | 1.0 | 1.0 |
| Dry additives | | | |
| PVPVI/PVNO | 0.5 | 0.5 | 0.5 |
| Protease | 1.0 | 1.0 | 1.0 |
| Lipase | 0.4 | 0.4 | 0.4 |
| Amylase | 0.1 | 0.1 | 0.1 |
| Cellulase | 0.1 | 0.1 | 0.1 |
| NOBS | — | 6.1 | 4.5 |
| Percarbonate | 3.0 | 7.0 | 8.0 |
| Sodium sulfate | — | 6.0 | — |
| Balance (Moisture and Miscellaneous) | 100 | 100 | 100 |

Example 10

The following high density and bleach-containing detergent formulations, according to the present invention were prepared:

| | P' | Q' | R' |
|---|---|---|---|
| Blown Powder | | | |
| STPP | 15.0 | 15.0 | 15.0 |
| MGDA | 2.0 | 2.0 | 2.0 |
| Sodium sulfate | 0.0 | 5.0 | 0.0 |
| LAS | 3.0 | 3.0 | 3.0 |
| QAS | — | 1.5 | 1.5 |
| DTPMP | 0.4 | 0.4 | 0.4 |
| CMC | 0.4 | 0.4 | 0.4 |
| MA/AA | 4.0 | 2.0 | 2.0 |
| Agglomerates | | | |
| LAS | 5.0 | 5.0 | 5.0 |
| TAS | 2.0 | 2.0 | 1.0 |
| Silicate | 3.0 | 3.0 | 4.0 |
| Zeolite A | 8.0 | 8.0 | 8.0 |
| Carbonate | 8.0 | 8.0 | 4.0 |
| Spray On | | | |
| Perfume | 0.3 | 0.3 | 0.3 |
| C45E7 | 2.0 | 2.0 | 2.0 |
| C25E3 | 2.0 | — | — |
| Dry additives | | | |
| Citrate | 5.0 | — | 2.0 |
| Bicarbonate | — | 3.0 | — |
| Carbonate | 8.0 | 15.0 | 10.0 |
| TAED | 6.0 | 2.0 | 5.0 |
| Percarbonate | 16.0 | 9.0 | 12.0 |

-continued

| | P' | Q' | R' |
|---|---|---|---|
| Mn Catalyst | 0.1 | — | — |
| Polyethylene oxide of MW 5,000,000 | — | — | 0.2 |
| Bentonite clay | — | — | 10.0 |
| Protease | 1.0 | 1.0 | 1.0 |
| Lipase | 0.4 | 0.4 | 0.4 |
| Amylase | 0.6 | 0.6 | 0.6 |
| Cellulase | 0.6 | 0.6 | 0.6 |
| Silicone antifoam | 5.0 | 5.0 | 5.0 |
| Dry additives | | | |
| Sodium sulfate | 0.0 | 3.0 | 0.0 |
| Balance (Moisture and Miscellaneous) | 100.0 | 100.0 | 100.0 |
| Density (g/liter) | 850 | 850 | 850 |

What is claimed is:

1. A bleaching composition consisting of:

(a) a percarbonate bleach compound which is stabilized with a coating material which is a mixed salt of sodium sulphate and sodium carbonate; and (b) an amino tricarboxylic acid or salt thereof wherein said amino tricarboxylic acid has the general formula:

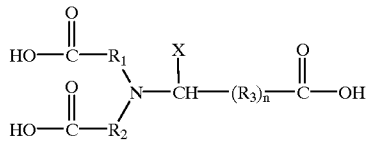

where $R_1$, $R_2$ and $R_3$ are alkyl groups or substituted alkyl groups of chain length C1 to C4; n is 0 or 1; and X is an organic substituent group.

2. A bleaching composition according to claim 1 wherein said percarbonate bleach is sodium percarbonate of formula $2Na_2CO_3.H_2O_2$.

3. A detergent composition according to claim 1 wherein said amino tricarboxylic acid is methyl glycine diacetic acid.

4. A method for cleaning soiled tableware comprising treating said tableware with an aqueous liquid having dissolved or dispensed therein a composition according to claim 1 in a machine dishwasher.

5. A method for cleaning soiled laundry comprising treating said laundry with an aqueous liquid having dissolved or dispensed therein a composition according to claim 1 in a washing machine.

6. The bleaching composition of claim 1, wherein the percarbonate bleach compound comprises from 2 percent to 30 percent by weight of the composition.

7. The bleaching composition of claim 1, wherein the percarbonate bleach compound comprises from 3 percent to 20 percent by weight of the composition.

8. The bleaching composition of claim 1, wherein the amino tricarboxylic acid comprises from 0.01 percent to 40 percent by weight of the composition.

9. The bleaching composition of claim 1, wherein the amino tricarboxylic acid comprises from 0.1 percent to 15 percent by weight of the composition.

* * * * *